US011572684B2

(12) United States Patent
Fox

(10) Patent No.: US 11,572,684 B2
(45) Date of Patent: Feb. 7, 2023

(54) RAFTER BRACKET

(71) Applicant: FOX HARDWOOD LUMBER COMPANY, L.L.C., Franklin, TN (US)

(72) Inventor: Samuel Fox, Franklin, TN (US)

(73) Assignee: Fox Hardwood Lumber Company, LLC, Franklin, TN (US)

( * ) Notice: Subject to any disclaimer, the term of this patent is extended or adjusted under 35 U.S.C. 154(b) by 0 days.

(21) Appl. No.: 17/535,536

(22) Filed: Nov. 24, 2021

(65) Prior Publication Data

US 2022/0081893 A1 Mar. 17, 2022

Related U.S. Application Data

(63) Continuation of application No. 16/883,563, filed on May 26, 2020, now abandoned, which is a continuation of application No. 16/517,528, filed on Jul. 19, 2019, now abandoned, which is a continuation of application No. 16/273,870, filed on Feb. 12, 2019, now Pat. No. 10,358,811, which is a continuation-in-part of application No. 16/113,022, filed on Aug. 27, 2018, now Pat. No. 10,202,766, which is a continuation-in-part of application No.

(Continued)

(51) Int. Cl.

| | |
|---|---|
| ***E04B 1/19*** | (2006.01) |
| ***E04B 1/26*** | (2006.01) |
| ***E04B 1/38*** | (2006.01) |

(52) U.S. Cl.

CPC ..... *E04B 1/1903* (2013.01); *E04B 1/2604* (2013.01); *E04B 2001/199* (2013.01); *E04B 2001/1963* (2013.01); *E04B 2001/1993* (2013.01); *E04B 2001/405* (2013.01)

(58) Field of Classification Search

CPC ..... E04B 1/2608; E04B 7/045; E04B 7/063; E04B 2001/2644; E04B 1/4114; E04B 1/40; E04B 1/1903; E04B 2001/1963; E04B 2001/1993; E04B 2001/199; E04B 1/2604; E04B 2001/405

See application file for complete search history.

(56) References Cited

U.S. PATENT DOCUMENTS 734,192 A * 7/1903 Randolph ..... E04G 7/18 52/301

963,585 A * 7/1910 Kimball ..... E06B 3/984 403/231

(Continued)

*Primary Examiner* — Rodney Mintz

(74) *Attorney, Agent, or Firm* — Shane Cortesi

(57) ABSTRACT

A rafter bracket configured to connect a vertical post to a rafter and beam(s) is described herein. The rafter bracket may include lower vertical side plates, a horizontal plate, and upper vertical side plates. The horizontal plate may be perpendicular to the upper and lower vertical side plates and may separate the upper vertical side plates from the lower vertical side plates. The horizontal plate and lower vertical side plates may create a lower cavity that receives the vertical post. Meanwhile, the rafter may be positioned on one of the upper vertical side plates and positioned between two of the upper vertical side plates and may be angled at an acute angle relative to the vertical post as well as the upper and lower vertical side plates. One or more of the lower vertical side plates may receive lateral plates that define a lateral cavity receiving the beam.

3 Claims, 21 Drawing Sheets

Related U.S. Application Data

15/912,203, filed on Mar. 5, 2018, now Pat. No. 10,100,508.

(56) References Cited

U.S. PATENT DOCUMENTS 1,657,243 A * 1/1928 Daniels ..... E04B 1/2604 248/300
1,848,085 A * 3/1932 Eisenschmidt ..... F16B 7/0493 D8/380
2,098,172 A * 11/1937 Walker ..... E04B 1/2604 403/241
2,317,125 A * 4/1943 Barnett ..... F16B 9/058 403/190
2,354,801 A * 8/1944 De Huff ..... F16B 9/058 403/389
2,611,160 A * 9/1952 Hanesse ..... A63H 33/107 182/228.1
2,768,434 A * 10/1956 Taylor ..... E04C 3/17 52/642
4,410,294 A * 10/1983 Gilb ..... F16B 9/058 403/403
4,924,648 A * 5/1990 Gilb ..... E04H 12/2253 52/297
5,230,198 A * 7/1993 Callies ..... E04B 7/045 52/696
5,857,295 A * 1/1999 Mikawa ..... E04B 7/045 52/712
7,316,098 B1 * 1/2008 Sackett ..... E04B 7/045 52/715
7,454,872 B2 * 11/2008 Cutforth ..... E02D 27/16 52/297
D703,029 S * 4/2014 Fox ..... D8/373
8,864,096 B1 * 10/2014 Fox ..... E04H 12/2292 248/539
9,175,472 B1 * 11/2015 Calini ..... E04B 1/40
9,297,161 B2 * 3/2016 Zimmerman ..... E04B 7/045
9,428,902 B1 * 8/2016 LoFranco ..... E04B 2/56
D775,512 S * 1/2017 White ..... D8/354
9,938,745 B1 * 4/2018 Fox ..... E04H 12/2292
10,053,854 B2 * 8/2018 Hildestad ..... E04B 1/3205
10,060,150 B1 * 8/2018 Fox ..... E04H 12/2269
10,100,508 B1 * 10/2018 Fox ..... E04B 7/045
10,202,766 B1 * 2/2019 Fox ..... E04B 1/2608
10,253,495 B1 * 4/2019 Calini ..... E04B 7/045
10,273,707 B1 * 4/2019 Fox ..... E04H 12/2269
10,280,617 B2 * 5/2019 Monty ..... F16B 15/00
10,294,656 B2 * 5/2019 Fox ..... E04B 1/5831
10,358,811 B1 * 7/2019 Fox ..... E04B 7/045
D858,255 S * 9/2019 Fox ..... F16B 7/0493 D8/354
D887,251 S * 6/2020 Fox ..... D8/354
D891,230 S * 7/2020 Fox ..... D8/354
D895,403 S * 9/2020 Fox ..... D8/354
2002/0112439 A1 * 8/2002 Rosas ..... E04B 1/2608 52/715
2002/0124483 A1 * 9/2002 Rosas ..... E04B 1/2608 52/712
2006/0150564 A1 * 7/2006 Dufault ..... E04B 7/045 52/702
2008/0282641 A1 * 11/2008 Sackett ..... E04B 7/045 52/715
2009/0178362 A1 * 7/2009 Jerke ..... E04H 9/14 52/656.9
2013/0067851 A1 * 3/2013 Zimmerman ..... E04B 1/2608 52/707
2015/0096165 A1 * 4/2015 Hutchinson ..... F16B 12/42 29/525.01
2016/0168840 A1 * 6/2016 Monty ..... E04C 3/02 52/261
2016/0177560 A1 * 6/2016 Hensen ..... E04B 1/2608 52/272
2016/0333570 A1 * 11/2016 Gueli ..... E04B 1/2612
2017/0298612 A1 * 10/2017 Hildestad ..... E04D 12/008
2018/0363287 A1 * 12/2018 Fox ..... E04B 1/2612
2019/0338508 A1 * 11/2019 Fox ..... E04B 1/2604
2020/0284021 A1 * 9/2020 Fox ..... E04B 1/2604
2021/0017756 A1 * 1/2021 Russel ..... E04B 1/2604

* cited by examiner

RAFTER BRACKET

RELATED APPLICATIONS

This application is a continuation of U.S. patent application Ser. No. 16/883,563, filed May 26, 2020, which is a continuation of U.S. patent application Ser. No. 16/517,528, filed Jul. 19, 2019, which is a continuation of U.S. patent application Ser. No. 16/273,870, filed Feb. 12, 2019, now U.S. Pat. No. 10,358,811, which is a continuation-in-part of U.S. patent application Ser. No. 16/113,022, filed Aug. 27, 2018, now U.S. Pat. No. 10,202,766, which is a continuation-in-part of U.S. patent application Ser. No. 15/912,203, filed Mar. 5, 2018, now U.S. Pat. No. 10,100,508. The contents of the aforementioned are incorporated by reference in their entirety.

BACKGROUND

Technical Field

The present invention relates to building materials, more particularly, brackets for connecting a wooden post to a rafter for use in a post and beam and timber frame construction.

Background of the Invention

In light frame construction, a birdsmouth joint, also known as a bird's beak cut, is a woodworking joint that is generally used to connect a roof rafter to the top plate of a vertical post (such as a wall stud). The birdsmouth joint is an indentation cut into the rafter which consists of a "seat cut" (the face of which rests on the top plate) and a "heel cut" or "plumb cut" (the face of which lies parallel to the supporting wall), forming a shape resembling a bird's mouth. Generally, the indentation should not extend unsupported on the interior in order to maintain the structural integrity of the rafter because the unsupported section can split along the grain of the wood. The joint is generally fastened with nails by toenailing the rafter from the side into the top plate below or using a strap. However, such system has a number of disadvantages, particularly if the indentation is not cut correctly, including 1) the strength of the connection of the roof system to the wall assembly; 2) reduced cross-section of the rafter due to the indentation; and 3) time and skill in cutting the indentation.

Thus, improved connections between studs and rafters are needed.

BRIEF SUMMARY

A rafter bracket configured to connect a vertical post of a building to a rafter of a roof of the building is described herein. The rafter bracket may include lower vertical side plates, a horizontal plate, and upper vertical side plates. Two of the upper vertical side plates and two of the lower vertical side plates may include fastener apertures. The horizontal plate may be perpendicular to the upper and lower vertical side plates, may be attached to the upper vertical side plate bottoms and to the lower vertical side plate tops and may separate the upper vertical side plates from the lower vertical side plates. The horizontal plate and lower vertical side plates may create a generally rectangular cavity that receives the vertical post and fasteners may be positioned through the lower vertical side plate fastener apertures and through the vertical post. Meanwhile, the rafter may be positioned on one of the upper vertical side plates (preferably the lowest of the upper vertical side plates) and positioned between two of the upper vertical side plates (which are preferably opposite each other and include the fastener apertures). The rafter may be angled at an acute angle relative to the vertical post as well as the upper and lower vertical side plates. Preferably, the vertical post and rafter are wood and the vertical post may be a wall stud.

The bracket may include one or more of the following features (and any combination thereof): 1) two of the upper vertical side posts may be opposite one another and perpendicular to another upper vertical side post so that the upper cavity is bounded on three sides; 2) two of the upper vertical side posts opposite each other may include the fastener apertures and may be taller than the other upper vertical side post (which may lack a fastener aperture and may be in the form of a ledge extending above the horizontal plate); 3) the rafter may be positioned on the shortest of the upper vertical side posts; 4) the bracket may be open opposite the shortest upper vertical side posts; 5) the upper vertical side posts may taper in decreasing height from an end adjacent to the shorter upper vertical side post to the open end to mirror the angle of the rafter; 6) the fastener apertures in each of the upper vertical side posts may be offset to mirror the angle of the rafter and the taper and the upper vertical side posts (including fastener apertures) may be mirror images of each other; 7) two of the lower vertical side posts may be opposite one another and perpendicular to two other upper vertical side post so that the lower cavity is bounded on four sides; 8) two of the upper vertical side posts opposite each other may include the fastener apertures and may be taller than the other upper vertical side posts (which may lack a fastener aperture and may be in the form of ledge extending below the horizontal plate); 9) the fastener apertures in the opposite lower vertical side posts may be aligned; 10) bolts, lags, screws or other fasteners may be positioned through the upper vertical side post fastener apertures and through the rafter and additional fasteners may be positioned through the lower vertical side post fastener apertures and the vertical post to secure the rafter and vertical post in place; 11) the distance between the upper vertical side plates with fastener apertures (which may be tapered as described above) may be less than the distance between the lower vertical side plates with fastener apertures to provide stability; 12) the upper vertical side plates with fastener apertures may be perpendicular to the lower vertical side plates with fastener apertures to provide stability; 13) the shortest of the upper vertical side plates may be low enough so that the rafter extends relative to the vertical side plates and vertical post at an angle less than 60 (preferably less than 60 degrees); 14) the rafter may also be positioned on the open end of the bracket opposite the lowest upper vertical side plate; 15) the lower vertical side plates with fastener apertures may each comprise a variable width with a wider portion and a narrower portion and the shorter lower vertical side plates may extend between the wider portions; 16) the shorter upper vertical side plate top may be generally flat as it extends between the taller upper vertical side plates; 17) as shown in the drawings, the vertical post may not touch the rafter when the vertical post and the rafter are positioned in the rafter bracket; 18) the horizontal plate may be generally rectangular in shape and the lower vertical side plates may be spaced about the perimeter of the horizontal plate, whereas the upper vertical side plates may be indented as shown in the drawings; 19) as shown in the drawings, the rafter need not be specially cut at the interface between the rafter and rafter bracket; 20) one or more lateral plates that extend from one or more of the lower vertical side plates (and away from the lower cavity) in order to join one or more beams to the rafter and vertical post; and/or 21) one or more braces supporting the lateral plates.

Without being bound by any particular theory, it is believed that the rafter bracket may provide a number of advantages including: 1) providing a stronger connection method of the roof system to the wall assembly; 2) allows the rafter to retain greater structural integrity because no birdsmouth joint is made, which by necessity reduces the cross sectional area of the rafter significantly; and 3) facilitates faster and cheaper construction due to the fact that multiple specialty cuts are not required for each rafter.

In some embodiments, the present disclosure provides a rafter bracket configured to connect a vertical post of a building to a rafter of the building, the rafter bracket comprising: a first lower vertical side plate comprising at least one first lower vertical side plate fastener aperture, a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and generally perpendicular to the first lower vertical side plate height; a second lower vertical side plate opposite the first lower vertical side plate and extending generally parallel to the first lower vertical side plate, the second lower vertical side plate comprising at least one second lower vertical side plate fastener aperture, a second lower vertical side plate top, a second lower vertical side plate bottom, a second lower vertical side plate height extending from the second lower vertical side plate top to the second lower vertical side plate bottom and generally parallel to the first lower vertical side plate height, a second lower vertical side plate first end, a second lower vertical side plate second end opposite the first end, and a second lower vertical side plate width extending from the second lower vertical side plate first end to the second lower vertical side plate second end and generally perpendicular to the first lower vertical side plate height; a third lower vertical side plate extending generally perpendicular to (and preferably extending between) the first and second lower vertical side plates and comprising a third lower vertical side plate top, a third lower vertical side plate bottom, a third lower vertical side plate height extending from the third lower vertical side plate top to the third lower vertical side plate bottom and generally parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and generally perpendicular to the first and second lower vertical side plate widths; a fourth lower vertical side plate opposite the third lower vertical side plate, extending generally parallel to the third lower vertical side plate and extending generally perpendicular to (and preferably extending between) the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and generally parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and generally parallel to the third lower vertical side plate length; a horizontal plate connected to at least one of (and preferably all) the first, second, third and fourth lower vertical side plates (preferably the tops of each), the horizontal plate located above the first, second, third and fourth lower vertical side plate bottoms (and preferably extending from the first lower vertical side plate to the second lower vertical side plate), the horizontal plate extending generally perpendicular to the first, second, third, and fourth lower vertical side plate heights, the horizontal plate comprising a horizontal plate first end, a horizontal plate second end, a horizontal plate width extending from the horizontal plate first end to the horizontal plate second end and generally parallel to the first lower vertical side plate width and second lower vertical side plate width, a horizontal plate proximal end, a horizontal plate distal end, and a horizontal plate length extending from the horizontal plate proximal end to the horizontal plate distal end and generally perpendicular to the horizontal plate width; a lower cavity defined by the first, second, third and fourth lower vertical side plates; a first upper vertical side plate comprising at least one first upper vertical side plate fastener aperture, the first upper vertical side plate having a first upper vertical side plate top located above the first, second, third and fourth lower vertical side plate tops and above the horizontal plate, a first upper vertical side plate bottom (preferably attached to the horizontal plate), a first upper vertical side plate height extending from the first upper vertical side plate top to the first upper vertical side plate bottom and generally parallel to the first and second lower vertical side plate heights, a first upper vertical side plate first end, a first upper vertical side plate second end opposite the first end, and a first upper vertical side plate length extending from the first upper vertical side plate first end to the first upper vertical side plate second end and generally perpendicular to the first upper vertical side plate height; a second upper vertical side plate opposite the first upper vertical side plate and extending generally parallel to the first upper vertical side plate, the second upper vertical side plate comprising at least one second upper vertical side plate fastener aperture, the second upper vertical side plate having a second upper vertical side plate top located above the first, second, third and fourth lower vertical side plate tops and above the horizontal plate, a second upper vertical side plate bottom (preferably attached to the horizontal plate), a second upper vertical side plate height extending from the second upper vertical side plate top to the second upper vertical side plate bottom and generally parallel to the first and second lower vertical side plate heights, a second upper vertical side plate first end, a second upper vertical side plate second end opposite the first end, and a second upper vertical side plate length extending from the second upper vertical side plate first end to the second upper vertical side plate second end and generally perpendicular to the first and second upper vertical side plate height; a third upper vertical side plate extending generally perpendicular to (and preferably extending from) the first and second upper vertical side plates and comprising a third upper vertical side plate top (preferably located above the first, second, third and fourth lower vertical side plate tops) located above the horizontal plate, a third upper vertical side plate bottom (preferably attached to the horizontal plate), a third upper vertical side plate height extending from the third upper vertical side plate top to the third upper vertical side bottom and generally parallel to the first and second lower vertical side plate heights, a third upper vertical side plate first end, a third upper vertical side plate second end opposite the first end, and a third upper vertical side plate length extending from the third upper vertical side plate first end to the third upper vertical side plate second end and generally perpendicular to the first and second upper vertical side plate length; an upper cavity defined by the first upper vertical side plate, second upper vertical side plate, third upper vertical side plate, and horizontal plate; wherein the first lower vertical side plate and second lower vertical side plate are separated a first distance, the first distance substantially constant along the first lower vertical side plate and second lower vertical side plate widths and generally parallel to the horizontal plate length, wherein the first upper vertical side plate and second upper vertical side plate are separated a second distance, the second distance substantially constant along the first upper vertical side plate and second upper vertical side plate lengths, wherein a vertical post of a building is positioned between the first, second, third and fourth lower vertical side plate in the lower cavity, wherein a rafter of the building is positioned on the third upper vertical side plate top and between the first and second upper vertical side plates, wherein at least one upper fastener is positioned through a fastener aperture of the first upper vertical side plate, through the rafter and then through the second upper vertical side plate, and further wherein at least one lower fastener is positioned through a fastener aperture of the first lower vertical side plate, through the vertical post and then through the second lower vertical side plate.

Optionally, the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures, wherein the first upper vertical side plate comprises a plurality of first upper vertical side plate apertures, and further wherein the second upper vertical side plate comprises a plurality of second upper vertical side apertures aligned with the first upper vertical side plate fastener apertures, and further wherein each fastener aperture comprises a fastener. Optionally, the first upper vertical side plate comprises at least two upper vertical side plate fastener apertures adjacent to the first upper vertical side plate first end, wherein the first upper vertical side plate comprises at least two upper vertical side plate fastener apertures adjacent to the first upper vertical side plate second end, wherein the second upper vertical side plate comprises at least two upper vertical side plate fastener apertures adjacent to the second upper vertical side plate first end, wherein the second upper vertical side plate comprises at least two second upper vertical side plate fastener apertures adjacent to the second upper vertical side plate second end, wherein the third upper vertical side plate is adjacent to the first and second upper vertical side plate first ends, wherein at least one first upper vertical side plate fastener aperture adjacent to the first upper vertical side plate first end is above all of the first upper vertical side plate fastener apertures adjacent to the first upper vertical side plate second end, wherein at least one second upper vertical side plate fastener aperture adjacent to the upper vertical side plate first end is above all of the second upper vertical side plate fastener apertures adjacent to the second upper vertical side plate second end, and further wherein the rafter extends upwardly at an acute angle (preferably of less than 60, more preferably less than 45 degrees) relative to the first and second upper vertical side plate heights from the first and second upper vertical side plate second ends to the first and second upper vertical side plate first ends. Optionally, the rafter bracket is open opposite the third upper vertical side plate and further wherein the third upper vertical side plate is adjacent to the first and second upper vertical side plate first ends. Optionally, the first and second upper vertical side plates each comprise a variable height, wherein the first upper vertical side plate tapers in decreasing height from the first upper vertical side plate first end to the first upper vertical side plate second end and further wherein the second upper vertical side plate tapers in decreasing height from the second upper vertical side plate first end to the second upper vertical side plate second end. Optionally, the third upper vertical side plate top is located below the tops of the first and second upper vertical side plate along the entire length of the first and second upper vertical side plates. Optionally, the least two upper vertical side plate fastener apertures adjacent to the first upper vertical side plate first end are aligned in a first vertical row generally parallel to the first upper vertical side plate height, wherein the at least two upper vertical side plate fastener apertures adjacent to the first upper vertical side plate second end are aligned in a second vertical row generally parallel to the first upper vertical side plate height, wherein the at least two upper vertical side plate fastener apertures adjacent to the second upper vertical side plate first end are aligned in a first vertical row generally parallel to the second upper vertical side plate height, and further wherein the at least two second upper vertical side plate fastener apertures adjacent to the second upper vertical side plate second end are aligned in a second vertical row generally parallel to the first upper vertical side plate height. Optionally, the vertical post comprises a vertical post top end located in the lower cavity, a vertical post bottom end, a vertical post height extending from the vertical post top end to the vertical post bottom end and generally parallel to the first and second lower vertical side plate heights and the first and second upper vertical side plate heights, wherein the rafter comprises a rafter first end, a rafter second end, and a rafter length extending from the rafter first end to the rafter second end, and further wherein the rafter length is angled relative to the vertical post height and the first and second upper vertical side plate heights at an angle less than 60 degrees. Optionally, the first and second upper vertical side plates are oriented approximately 90 degrees relative to the first and second lower vertical side plates, and further wherein the third upper vertical side plate is oriented approximately 90 degrees relative to the third and fourth lower vertical side plates. Optionally, the first and second upper vertical side plates are substantially mirror images of each other and further wherein the first and second lower vertical side plates are substantially mirror images of each other. Optionally, the third and fourth lower vertical side plates extend between the first lower vertical side plate and the second lower vertical side plate and the third upper vertical side plate extends between the first upper vertical side plate and the second upper vertical side plate. Optionally, the third and fourth lower vertical side plate heights are less than the first and second lower vertical side plate heights. Optionally, the first and second lower vertical side plate each comprise a variable width with a wider portion and a narrower portion and the third and fourth lower vertical side plates extend between the first and second lower vertical side plate wider portions. Optionally, the third upper vertical side plate top is generally flat as it extends between the first and second upper vertical side plates. Optionally, the lower cavity is generally rectangular in shape. Optionally, the first and second lower vertical side plate tops are attached to the horizontal plate and further wherein the first, second, and third upper vertical side plate bottoms are attached to the horizontal plate. Optionally, the third and fourth lower vertical side plate heights are less than the first and second lower vertical side plate heights and further wherein the third upper vertical side plate height is no more than about ⅓ the median height of the first and second upper vertical side plate. Optionally, the vertical post and the rafter are comprised of wood and the rafter bracket is comprised of metal. Optionally, the vertical post is a wall stud of the building. Optionally, the rafter is also positioned on the horizontal plate. Optionally, the second distance is less than the first distance.

In still further embodiments, the present disclosure provides a rafter bracket configured to connect a vertical post of a building to a rafter of the building, the rafter bracket comprising: a first lower vertical side plate comprising a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and generally perpendicular to the first lower vertical side plate height; a second lower vertical side plate opposite the first lower vertical side plate and extending generally parallel to the first lower vertical side plate, the second lower vertical side plate comprising a second lower vertical side plate top, a second lower vertical side plate bottom, a second lower vertical side plate height extending from the second lower vertical side plate top to the second lower vertical side plate bottom and generally parallel to the first lower vertical side plate height, a second lower vertical side plate first end, a second lower vertical side plate second end opposite the first end, and a second lower vertical side plate width extending from the second lower vertical side plate first end to the second lower vertical side plate second end and generally perpendicular to the first lower vertical side plate height; a third lower vertical side plate extending generally perpendicular to (and preferably extending between) the first and second lower vertical side plates and comprising a third lower vertical side plate top, a third lower vertical side plate bottom, a third lower vertical side plate height extending from the third lower vertical side plate top to the third lower vertical side plate bottom and generally parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and generally perpendicular to the first and second lower vertical side plate widths; a fourth lower vertical side plate opposite the third lower vertical side plate, extending generally parallel to the third lower vertical side plate and extending generally perpendicular to (and preferably extending between) the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and generally parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and generally parallel to the third lower vertical side plate length; a horizontal plate connected to at least one (and preferably all of) the first, second, third and fourth lower vertical side plates (preferably the tops of each), the horizontal plate located above the first, second, third and fourth lower vertical side plate bottoms (and preferably extending from the first lower vertical side plate to the second lower vertical side plate), the horizontal plate extending generally perpendicular to the first, second, third, and fourth lower vertical side plate heights, the horizontal plate comprising a horizontal plate first end, a horizontal plate second end, a horizontal plate width extending from the horizontal plate first end to the horizontal plate second end and generally parallel to the first lower vertical side plate width and second lower vertical side plate width, a horizontal plate proximal end, a horizontal plate distal end, and a horizontal plate length extending from the horizontal plate proximal end to the horizontal plate distal end and generally perpendicular to the horizontal plate width; a lower cavity defined by the first, second, third and fourth lower vertical side plates; a first upper vertical side plate comprising at least one first upper vertical side plate fastener aperture, the first upper vertical side plate having a first upper vertical side plate top located above the first, second, third and fourth lower vertical side plate tops and above the horizontal plate, a first upper vertical side plate bottom (preferably attached to the horizontal plate), a first upper vertical side plate height extending from the first upper vertical side plate top to the first upper vertical side plate bottom and generally parallel to the first and second lower vertical side plate heights, a first upper vertical side plate first end, a first upper vertical side plate second end opposite the first end, and a first upper vertical side plate length extending from the first upper vertical side plate first end to the first upper vertical side plate second end and generally perpendicular to the first upper vertical side plate height; a second upper vertical side plate opposite the first upper vertical side plate and extending generally parallel to the first upper vertical side plate, the second upper vertical side plate comprising at least one second upper vertical side plate fastener aperture, the second upper vertical side plate having a second upper vertical side plate top located above the first, second, third and fourth lower vertical side plate tops and above the horizontal plate, a second upper vertical side plate bottom (preferably attached to the horizontal plate), a second upper vertical side plate height extending from the second upper vertical side plate top to the second upper vertical side plate bottom and generally parallel to the first and second lower vertical side plate heights, a second upper vertical side plate first end, a second upper vertical side plate second end opposite the first end, and a second upper vertical side plate length extending from the second upper vertical side plate first end to the second upper vertical side plate second end and generally perpendicular to the first and second upper vertical side plate height; a third upper vertical side plate extending generally perpendicular to (and preferably extending from) the first and second upper vertical side plates and comprising a third upper vertical side plate top (preferably located above the first, second, third and fourth lower vertical side plate tops) located above the horizontal plate, a third upper vertical side plate bottom (preferably attached to the horizontal plate), a third upper vertical side plate height extending from the third upper vertical side plate top to the third upper vertical side bottom and generally parallel to the first and second lower vertical side plate heights, a third upper vertical side plate first end, a third upper vertical side plate second end opposite the first end, and a third upper vertical side plate length extending from the third upper vertical side plate first end to the third upper vertical side plate second end and generally perpendicular to the first and second upper vertical side plate length; an upper cavity defined by the first upper vertical side plate, second upper vertical side plate, third upper vertical side plate, and horizontal plate; wherein the first lower vertical side plate and second lower vertical side plate are separated a first distance, the first distance substantially constant along the first lower vertical side plate and second lower vertical side plate widths and generally parallel to the horizontal plate length, wherein the first upper vertical side plate and second upper vertical side plate are separated a second distance, the second distance substantially constant along the first upper vertical side plate and second upper vertical side plate lengths, wherein a vertical post of a building is configured to be positioned between the first, second, third and fourth lower vertical side plate in the lower cavity, wherein a rafter of the building is configured to be positioned on the third upper vertical side plate top and between the first and second upper vertical side plates, wherein the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures, wherein the first upper vertical side plate comprises a plurality of first upper vertical side plate apertures, and further wherein the second upper vertical side plate comprises a plurality of second upper vertical side apertures aligned with the first upper vertical side plate fastener apertures.

Optionally, the first upper vertical side plate comprises at least two upper vertical side plate fastener apertures adjacent to the first upper vertical side plate first end, wherein the first upper vertical side plate comprises at least two upper vertical side plate fastener apertures adjacent to the first upper vertical side plate second end, wherein the second upper vertical side plate comprises at least two upper vertical side plate fastener apertures adjacent to the second upper vertical side plate first end, wherein the second upper vertical side plate comprises at least two second upper vertical side plate fastener apertures adjacent to the second upper vertical side plate second end, wherein the third upper vertical side plate is adjacent to the first and second upper vertical side plate first ends, wherein at least one first upper vertical side plate fastener aperture adjacent to the first upper vertical side plate first end is above all of the first upper vertical side plate fastener apertures adjacent to the first upper vertical side plate second end, wherein at least one second upper vertical side plate fastener aperture adjacent to the second upper vertical side plate first end is above all of the second upper vertical side plate fastener apertures adjacent to the second upper vertical side plate second end, and further wherein the rafter bracket is configured to allow a rafter to extend upwardly at an angle of less than 60 degrees relative to the first and second upper plate heights from the first and second upper vertical side plate second ends to the first and second upper vertical side plate first ends. Optionally, the rafter bracket is open opposite the third upper vertical side plate. Optionally, the first and second upper vertical side plate each comprise a variable height, wherein the first upper vertical side plate tapers in decreasing height from the first upper vertical side plate first end to the first upper vertical side plate second end and further wherein the second upper vertical side plate tapers in decreasing height from the second upper vertical side plate first end to the second upper vertical side plate second end.

In still further embodiments, the present disclosure provides a rafter bracket configured to connect a vertical post of a building to a rafter of the building. The rafter bracket may include a first lower vertical side plate comprising at least one first lower vertical side plate fastener aperture, a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and substantially perpendicular to the first lower vertical side plate height. The rafter bracket may also include a second lower vertical side plate opposite the first lower vertical side plate and extending substantially parallel to the first lower vertical side plate, the second lower vertical side plate comprising at least one second lower vertical side plate fastener aperture, a second lower vertical side plate top, a second lower vertical side plate bottom, a second lower vertical side plate height extending from the second lower vertical side plate top to the second lower vertical side plate bottom and substantially parallel to the first lower vertical side plate height, a second lower vertical side plate first end, a second lower vertical side plate second end opposite the first end, and a second lower vertical side plate width extending from the second lower vertical side plate first end to the second lower vertical side plate second end and substantially perpendicular to the first lower vertical side plate height. The rafter bracket may also include a horizontal plate connected to at least one of the first and second lower vertical side plates, the horizontal plate located above the first and second lower vertical side plate bottoms, the horizontal plate extending substantially perpendicular to the first and second lower vertical side plate heights, the horizontal plate comprising a horizontal plate first end, a horizontal plate second end, a horizontal plate width extending from the horizontal plate first end to the horizontal plate second end and substantially parallel to the first lower vertical side plate width and second lower vertical side plate width, a horizontal plate proximal end, a horizontal plate distal end, and a horizontal plate length extending from the horizontal plate proximal end to the horizontal plate distal end and substantially perpendicular to the horizontal plate width. The rafter bracket may also include a lower cavity defined by the first and second lower vertical side plates. The rafter bracket may also include at least one upper brace plate comprising a brace plate top above the first and second lower vertical side plate tops and above the horizontal plate, a brace plate bottom extending from the horizontal plate, a brace plate height extending from the brace plate top to the brace plate bottom and substantially parallel to the first and second lower vertical side plate heights, a brace plate first end, a brace plate second end, and a brace plate length extending from the brace plate first end to the brace plate second end and generally perpendicular to the brace plate height. The rafter bracket may also include an upper plate resting on the brace plate top, the upper plate oriented at an angle greater than 1 degrees and less than 90 degrees relative to the horizontal plate, and the upper plate comprising a bottom surface facing the horizontal plate and a top surface opposite the bottom surface. Optionally, the upper plate comprises at least one fastener aperture extending from the upper plate top surface to the upper plate bottom surface. Optionally, the first lower vertical side plate and second lower vertical side plate are separated a first distance, the first distance substantially constant along the first lower vertical side plate and second lower vertical side plate widths and substantially parallel to the horizontal plate length. Optionally, the vertical post of the building is positioned between the first and second vertical side plates in the lower cavity. Optionally, the rafter of the building is positioned on the upper plate top surface. Optionally, at least one upper fastener is positioned through an upper plate fastener aperture and into the rafter. Optionally, at least one lower fastener is positioned through a fastener aperture of the first lower vertical side plate and into the vertical post.

Optionally, the at least one upper brace plate tapers in decreasing height from the first end to the second end. Optionally, the at least one upper brace plate is substantially triangular in shape. Optionally, the at least one lower fastener is positioned through a fastener aperture of the first lower vertical side plate, through the vertical post and then through a fastener aperture of the second lower vertical side plate. Optionally, the upper plate bottom surface is located above the horizontal plate. Optionally, the rafter bracket comprises two identically shaped and sized upper brace plates separated by a space and oriented substantially parallel to each other. Optionally, the upper plate is oriented at an angle of between about 5 degrees and about 60 degrees relative to the horizontal plate. Optionally, the rafter bracket further comprises: a third lower vertical side plate extending substantially perpendicular to the first and second lower vertical side plates and comprising a third lower vertical side plate top, a third lower vertical side plate bottom, a third lower vertical side plate height extending from the third lower vertical side plate top to the third lower vertical side plate bottom and substantially parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and substantially perpendicular to the first and second lower vertical side plate widths; and a fourth lower vertical side plate opposite the third lower vertical side plate, extending substantially parallel to the third lower vertical side plate and extending substantially perpendicular to the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and substantially parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and substantially parallel to the third lower vertical side plate length. Optionally, the vertical post of the building is positioned between the third and fourth vertical side plates in the lower cavity. Optionally, the at least one upper brace plate top is located above the third and fourth lower vertical side plate tops. Optionally, the horizontal plate is connected to the third and fourth lower vertical side plates, wherein the horizontal plate located is above the third and fourth lower vertical side plate bottoms, and further wherein the horizontal plate extends substantially perpendicular to the third and fourth lower vertical side plate heights. Optionally, the third and fourth lower vertical side plates each comprise at least one fastener aperture, wherein at least one fastener aperture of the third and fourth lower vertical side plates are aligned and located. Optionally, all fastener apertures of the first and second lower vertical side plates are vertically offset from the fastener apertures of the third and fourth lower vertical side plates. Optionally, at least one of the first, second, third and fourth lower vertical side plates comprise a plurality of lateral plates extending laterally away from the respective lower vertical side plate and lower cavity and defining a lateral cavity, wherein a beam of the building is located in the lateral cavity, wherein at least one of the plurality of lateral plates comprises a fastener aperture, and further wherein a fastener is positioned through the lateral plate fastener aperture and through the beam. Optionally, the lateral cavity has an open top and the plurality of lateral plates border the beam on two sides and a bottom of the lateral cavity. Optionally, the plurality of lateral plates comprise first and second side lateral plates, the first and second side lateral plates oriented substantially parallel to each other and defining opposite sides the lateral cavity and bordering the beam on two sides, each of the first and second side lateral plates having a height substantially parallel to the first and second lower vertical side plate heights, and further wherein the respective first, second, third or fourth lower vertical side plate comprising the plurality of lateral plates border the beam on another side. Optionally, the plurality of lateral plates further comprise a bottom lateral plate bordering the beam on a bottom of the lateral cavity. Optionally, the bottom lateral plate is substantially parallel to the horizontal plate. Optionally, the plurality of lateral plates are not directly attached to each other. Optionally, the rafter bracket further comprises a substantially triangular brace located below the bottom lateral plate and attached to both the bottom lateral plate and the respective lower vertical side plate comprising the plurality of lateral plates. Optionally, each of the plurality of lateral plates comprise a lateral plate fastener aperture and further wherein fasteners are positioned through the lateral plate fastener apertures and through the beam. Optionally, a plurality of the first, second, third and fourth lower vertical side plates each comprise a respective said plurality of lateral plates extending laterally away from the respective lower vertical side plate and lower cavity and creating a respective said lateral cavity, wherein a respective said beam is located in each lateral cavity and further wherein, for each the first, second, third and fourth lower vertical side plate comprising the respective plurality of lateral plates, at least one of the plurality of lateral plates comprises a fastener aperture, and further wherein a fastener is positioned through at least one lateral plate fastener aperture and through the respective beam. Optionally, the rafter bracket further includes a brace extending between and attached to the respective lateral plate of one of the first, second, third and fourth lower vertical side plates and a lateral plate of another of the first, second, third and fourth lower vertical side plates. Optionally, the beam and the vertical post are located directly below the rafter. Optionally, the beam and rafter are located in the same plane. Optionally, the vertical post comprises a vertical post top end located in the lower cavity, a vertical post bottom end, a vertical post height extending from the vertical post top end to the vertical post bottom end and substantially parallel to the first and second lower vertical side plate heights, wherein the rafter comprises a rafter first end, a rafter second end, and a rafter length extending from the rafter first end to the rafter second end, and further wherein the rafter length is angled relative to the vertical post height and the first and second lower vertical side plate heights at an angle less than 60 degrees, and further wherein the beam is substantially perpendicular to the vertical post. Optionally, the rafter extends upwardly at an acute angle relative to the horizontal plate from the brace plate first end to the brace plate second end. Optionally, the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures. Optionally, the lower cavity is substantially rectangular in shape. Optionally, the vertical post is a wall stud of the building.

In still further embodiments, the present disclosure provides a rafter bracket configured to connect a vertical post of a building to a rafter of the building. The rafter bracket may include a first lower vertical side plate comprising a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and substantially perpendicular to the first lower vertical side plate height. The rafter bracket may also include a second lower vertical side plate opposite the first lower vertical side plate and extending substantially parallel to the first lower vertical side plate, the second lower vertical side plate comprising a second lower vertical side plate top, a second lower vertical side plate bottom, a second lower vertical side plate height extending from the second lower vertical side plate top to the second lower vertical side plate bottom and substantially parallel to the first lower vertical side plate height, a second lower vertical side plate first end, a second lower vertical side plate second end opposite the first end, and a second lower vertical side plate width extending from the second lower vertical side plate first end to the second lower vertical side plate second end and substantially perpendicular to the first lower vertical side plate height. The rafter bracket may also include a third lower vertical side plate extending substantially perpendicular to the first and second lower vertical side plates and comprising a third lower vertical side plate top, a third lower vertical side plate bottom, a third lower vertical side plate height extending from the third lower vertical side plate top to the third lower vertical side plate bottom and substantially parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and substantially perpendicular to the first and second lower vertical side plate widths. The rafter bracket may also include a fourth lower vertical side plate opposite the third lower vertical side plate, extending substantially parallel to the third lower vertical side plate and extending substantially perpendicular to the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and substantially parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and substantially parallel to the third lower vertical side plate length. The rafter bracket may also include a horizontal plate connected to at least one of the first, second, third and fourth lower vertical side plates, the horizontal plate located above the first, second, third and fourth lower vertical side plate bottoms, the horizontal plate extending substantially perpendicular to the first, second, third, and fourth lower vertical side plate heights, the horizontal plate comprising a horizontal plate first end, a horizontal plate second end, a horizontal plate width extending from the horizontal plate first end to the horizontal plate second end and substantially parallel to the first lower vertical side plate width and second lower vertical side plate width, a horizontal plate proximal end, a horizontal plate distal end, and a horizontal plate length extending from the horizontal plate proximal end to the horizontal plate distal end and substantially perpendicular to the horizontal plate width. The rafter bracket may also include a lower cavity defined by the first, second, third and fourth lower vertical side plates. The rafter bracket may also include at least one upper brace plate comprising a brace plate top above the first, second, third and fourth lower vertical side plate tops and above the horizontal plate, a brace plate bottom extending from the horizontal plate, a brace plate height extending from the brace plate top to the brace plate bottom and substantially parallel to the first and second lower vertical side plate heights, a brace plate first end, a brace plate second end, and a brace plate length extending from the brace plate first end to the brace plate second end and generally perpendicular to the brace plate height. The rafter bracket may also include an upper plate resting on the brace plate top, the upper plate oriented at an angle of greater than 1 degrees and less than 90 degrees relative to the horizontal plate, the upper plate comprising a bottom surface facing the horizontal plate and a top surface opposite the bottom surface. Optionally, the upper plate comprises at least one fastener aperture extending from the upper plate top surface to the upper plate bottom surface. Optionally, the first lower vertical side plate and second lower vertical side plate are separated a first distance, the first distance substantially constant along the first lower vertical side plate and second lower vertical side plate widths and substantially parallel to the horizontal plate length. Optionally, the vertical post of the building is configured to be positioned between the first, second, third and fourth lower vertical side plate in the lower cavity. Optionally, the rafter of the building is configured to be positioned on the upper plate top surface. Optionally, the at least one upper brace plate tapers in decreasing height from the first end to the second end and is substantially triangular in shape. Optionally, the rafter bracket comprises two identically shaped and sized upper brace plates separated by a space and oriented substantially parallel to each other. Optionally, at least one of the first, second, third and fourth lower vertical side plates comprise a plurality of lateral plates extending laterally away from the respective lower vertical side plate and lower cavity and forming a lateral cavity, wherein a beam of the building is configured to be positioned in the lateral cavity, wherein at least two of the plurality of lateral plates comprises at least one aligned fastener aperture, wherein the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures. Optionally, the upper plate bottom surface is located above the horizontal plate.

BRIEF DESCRIPTION OF THE DRAWINGS

in FIG. 4, the rafter bracket has been rotated as compared to FIG. 3.

in FIG. 5, the rafter bracket has been rotated as compared to FIG. 3.

in FIG. 6, the rafter bracket is in the same orientation as FIG. 5.

in FIG. 7, the rafter bracket is in the same orientation as FIG. 5.

in FIG. 8, the rafter bracket has been rotated 90 degrees as compared to FIG. 5.

in FIG. 9, the rafter bracket is in the same orientation as FIG. 5.

in FIG. 10, the third upper vertical side plate is lower as compared to FIG. 9, which allows the rafter to be placed at a more acute angle.

in FIG. 21, the third upper vertical side plate is lower as compared to FIG. 20, which allows the rafter to be placed at a more acute angle.

in FIG. 34, the rafter bracket has been rotated as compared to FIG. 33.

in FIG. 35, the rafter bracket has been rotated as compared to FIG. 34

in FIG. 36, the rafter bracket has been rotated as compared to FIG. 35.

DETAILED DESCRIPTION

Figure 1:
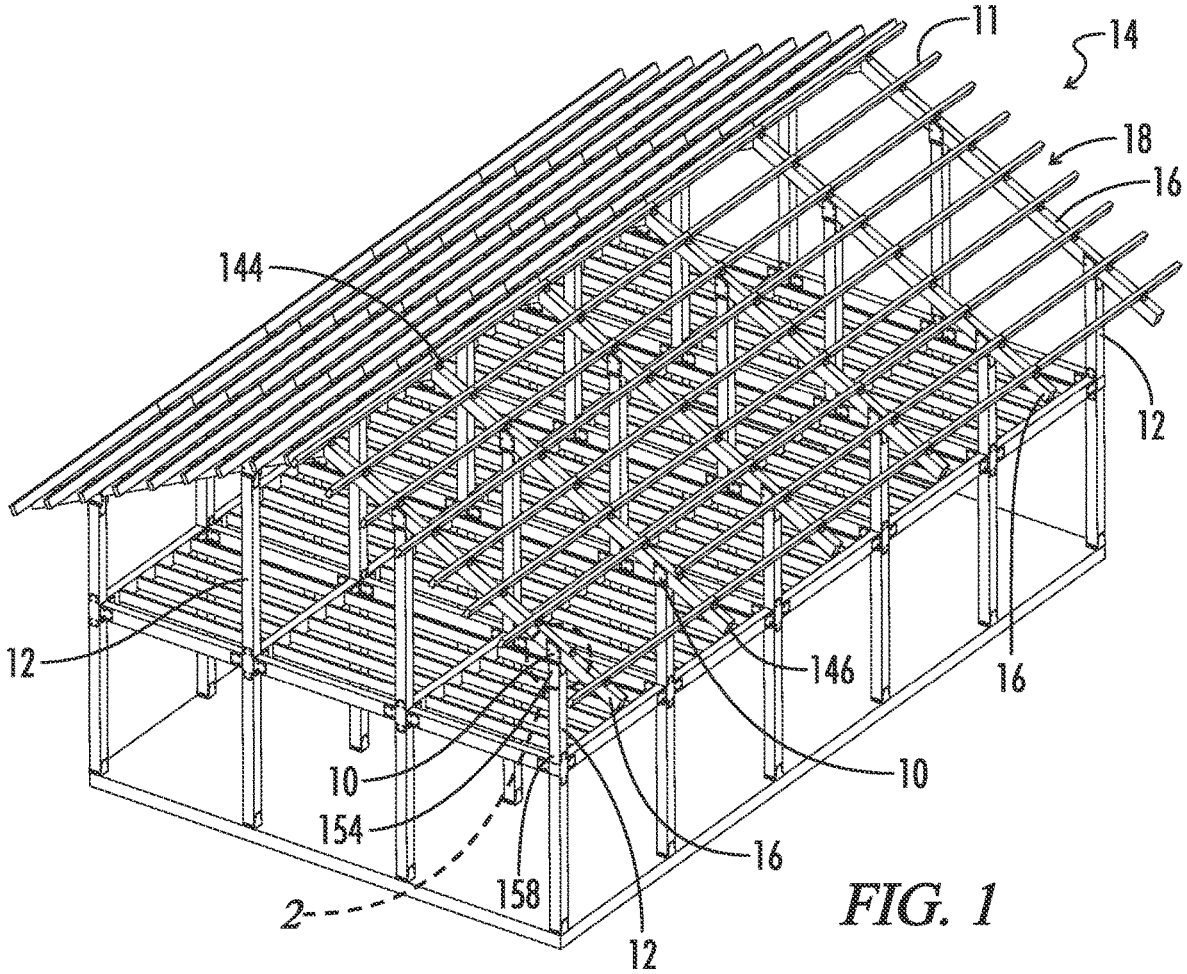
FIG. 1 is a side perspective view of a building utilizing a rafter bracket of one embodiment of the present invention.

With reference to FIGS. 1-10, the present invention provides a rafter bracket generally designated by the numeral 10. In the drawings, not all reference numbers are included in each drawing for the sake of clarity. It will be understood that the above drawings are CAD drawings drawn to scale.

Figure 2:
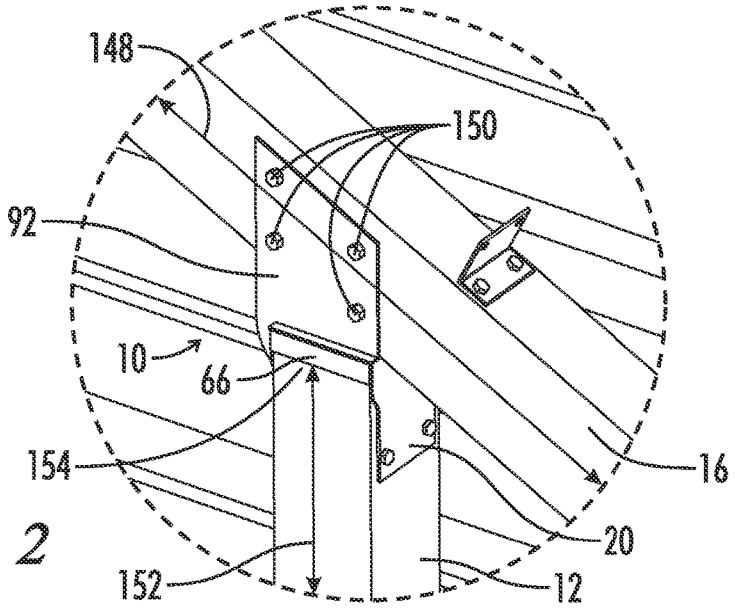
FIG. 2 is a close-up side perspective view of the circled area labelled 2 in FIG. 1 to better show the rafter bracket.
Figure 3:
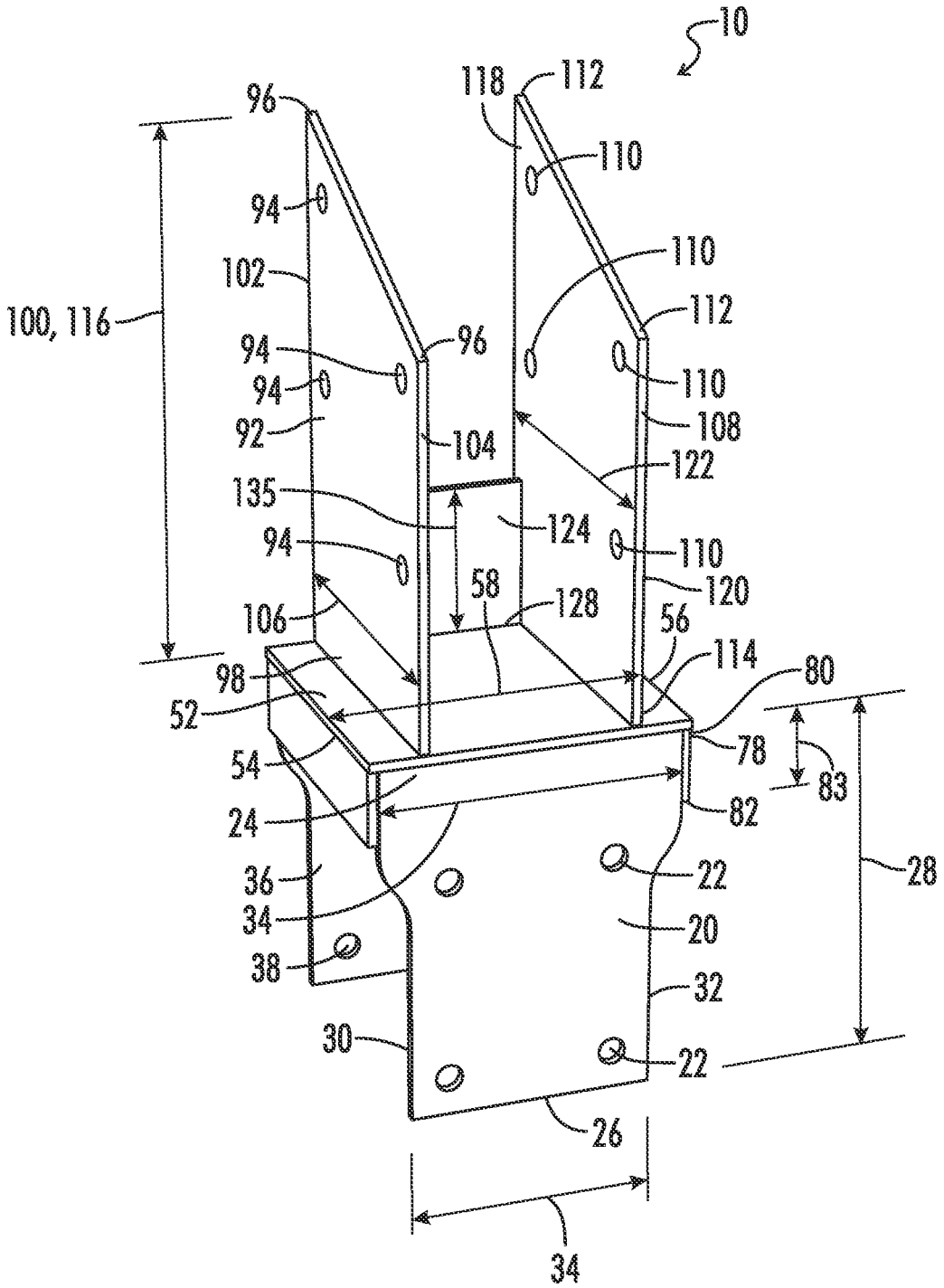
FIG. 3 is a side perspective view of a rafter bracket of another embodiment of the present invention.

As shown in FIGS. 1-10, the rafter bracket 10 may be configured to connect a vertical post 12 of a building 14 to a rafter 16 of the building 14 and may include a first lower vertical side plate 20 comprising at least one first lower vertical side plate fastener aperture/hole 22, a first lower vertical side plate top 24, a first lower vertical side plate bottom 26, a first lower vertical side plate height 28 extending from the first lower vertical side plate top 24 to the first lower vertical side plate bottom 26, a first lower vertical side plate first end 30, a first lower vertical side plate second end 32 opposite the first end 30, and a first lower vertical side plate width 34 extending from the first lower vertical side plate first end 30 to the first lower vertical side plate second end 32 and generally perpendicular to the first lower vertical side plate height 28. As best seen in FIGS. 2-10, the rafter bracket 10 may also include a second lower vertical side plate 36 opposite the first lower vertical side plate 20 and extending generally parallel to the first lower vertical side plate 20, the second lower vertical side plate 36 comprising at least one second lower vertical side plate fastener aperture/hole 38, a second lower vertical side plate top 40, a second lower vertical side plate bottom 42, a second lower vertical side plate height 44 extending from the second lower vertical side plate top 40 to the second lower vertical side plate bottom 42 and generally parallel to the first lower vertical side plate height 28, a second lower vertical side plate first end 46, a second lower vertical side plate second end 48 opposite the first end 46, and a second lower vertical side plate width 50 extending from the second lower vertical side plate first end 46 to the second lower vertical side plate second end 48 and generally perpendicular to the first and second lower vertical side plate heights 28, 44. As best seen in FIGS. 2-10, the rafter bracket 10 may optionally further include a third lower vertical side plate 66 extending generally perpendicular to (and preferably extending between) the first and second lower vertical side plates 20, 36 and comprising a third lower vertical side plate top 68, a third lower vertical side plate bottom 70, a third lower vertical side plate height 71 extending from the third lower vertical side plate top 68 to the third lower vertical side plate bottom 70 and generally parallel to the first and second lower vertical side plate heights 28, 44, a third lower vertical side plate proximal end 72, a third lower vertical side plate distal end 74, and a third lower vertical side plate length 76 that extends from the third lower vertical side plate proximal end 72 to the third lower vertical side plate distal end 74 and is generally perpendicular to the first and second lower vertical side plate widths 34, 50. As best seen in FIGS. 2-10, the rafter bracket 10 may further include a fourth lower vertical side plate 78 opposite the third lower vertical side plate 66, extending generally parallel to the third lower vertical side plate 66 and extending generally perpendicular to (and preferably extending between) the first and second lower vertical side plates 20, 36, the fourth lower vertical side plate 78 comprising a fourth lower vertical side plate top 80, a fourth lower vertical side plate bottom 82, a fourth lower vertical side plate height 83 extending from the fourth lower vertical side plate top 80 to the fourth lower vertical side plate bottom 82 and generally parallel to the first, second and third 71 lower vertical side plate heights 28, 44, 71, a fourth lower vertical side plate proximal end 84, a fourth lower vertical side plate distal end 86, and a fourth lower vertical side plate length 88 extending from the fourth lower vertical side plate proximal end 84 to the fourth lower vertical side plate distal end 86 and generally parallel to the third lower vertical side plate length 76. As best seen in FIGS. 2-10, the rafter bracket 10 may further include a horizontal plate 52 connected to the first, second, third and fourth lower vertical side plate 20, 36, 66, 78 (preferably the tops 24, 40, 68 and 80 of each). As best seen in FIGS. 2-10, the horizontal plate 52 may be located above the first, second, third and fourth lower vertical side plate bottoms 26, 42, 70, 82 (and preferably extends from the first lower vertical side plate 20 to the second lower vertical side plate 36 and from the third lower vertical side plate 66 to the fourth lower vertical side plate 78). As best seen in FIGS. 2-10, the horizontal plate 52 may extend generally perpendicular to the first, second, third, and fourth 83 lower vertical side plate heights 28, 44, 71, 83. As best seen in FIGS. 2-10, the horizontal plate 52 may be generally rectangular in shape and may include a horizontal plate first end 54, a horizontal plate second end 56, a horizontal plate width 58 extending from the horizontal plate first end 54 to the horizontal plate second end 56 and generally parallel to the first lower vertical side plate width 34 and second lower vertical side plate width 50, a horizontal plate proximal end 60, a horizontal plate distal end 62, and a horizontal plate length 64 extending from the horizontal plate proximal end 60 to the horizontal plate distal end 62 and generally perpendicular to the horizontal plate width 58 (and generally parallel to the third and fourth lower vertical side plate lengths 76, 88). As best seen in FIGS. 2-10, the rafter bracket 10 may also include a lower cavity 90 defined by the first, second, third and fourth lower vertical side plates 20, 36, 66, 78 configured to receive the top end 154 of a vertical post 12 (e.g., wall stud 12) of the building 14. In other words, the top end 154 of a generally rectangular vertical post 12 may be surrounded on all four sides by the first, second, third and fourth lower vertical side plates 20, 36, 66, 78, as best seen in FIG. 2. As best seen in FIGS. 2-10, the rafter bracket 10 may also include a first upper vertical side plate 92 comprising at least one first upper vertical side plate fastener aperture/hole 94, the first upper vertical side plate 92 having a first upper vertical side plate top 96 located above the first, second, third and fourth lower vertical side plate tops 24, 40, 68, 80 and above the horizontal plate 52, a first upper vertical side plate bottom 98 (preferably attached to the horizontal plate 52 and also above the first, second, third and fourth lower vertical side plate tops 24, 40, 68, 80), a first upper vertical side plate height 100 extending from the first upper vertical side plate top 96 to the first upper vertical side plate bottom 98 and generally parallel to the first and second lower vertical side plate heights 28, 44, a first upper vertical side plate first end 102, a first upper vertical side plate second end 104 opposite the first upper vertical side plate first end 102, and a first upper vertical side plate length 106 extending from the first upper vertical side plate first end 102 to the first upper vertical side plate second end 104 and generally perpendicular to the first upper vertical side plate height 100. As best seen in FIGS. 2-10, the rafter bracket 10 may also include a second upper vertical side plate 108 opposite the first upper vertical side plate 92 and extending generally parallel to the first upper vertical side plate 92, the second upper vertical side plate 108 comprising at least one second upper vertical side plate fastener aperture/hole 110, the second upper vertical side plate 108 having a second upper vertical side plate top 112 located above the first, second, third and fourth lower vertical side plate tops 24, 40, 68, 80 and above the horizontal plate 52, a second upper vertical side plate bottom 114 (preferably attached to the horizontal plate 52 and above the first, second, third and fourth lower vertical side plate tops 24, 40, 68, 80), a second upper vertical side plate height 116 extending from the second upper vertical side plate top 112 to the second upper vertical side plate bottom 114 and generally parallel to the first and second lower vertical side plate heights 28, 44, a second upper vertical side plate first end 118, a second upper vertical side plate second end 120 opposite the second upper vertical side plate first end 118, and a second upper vertical side plate length 122 extending from the second upper vertical side plate first end 118 to the second upper vertical side plate second end 120 and generally perpendicular to the first and second upper vertical side plate heights 100, 116 (and generally parallel to the first upper vertical side plate length 106). In some embodiments, the first and second upper vertical side plate bottoms 98, 114 extend below the top of the horizontal plate 52 as shown in FIG. 2 to provide more surface area for welding.

As best seen in FIGS. 2-10, the rafter bracket 10 may also optionally include a third upper vertical side plate 124 extending generally perpendicular to (and preferably extending between) the first and second upper vertical side plates 92, 108 and comprising a third upper vertical side plate top 126 (preferably located above the first, second, third and fourth lower vertical side plate tops 24, 40, 68, and 80) located above the horizontal plate 52 and below the first and second upper vertical side plate tops 96, 112 (preferably the tops 96 and 112 along the entire lengths 106 and 122 if the first and second upper vertical side plate tops 96, 112 are tapered), a third upper vertical side plate bottom 128 (preferably attached to the horizontal plate 52), a third upper vertical side plate height 135 extending from the third upper vertical side plate top 126 to the third upper vertical side bottom 128 and generally parallel to the first and second lower vertical side plate heights 28, 44, a third upper vertical side plate first end 130, a third upper vertical side plate second end 132 opposite the first end 130, and a third upper vertical side plate length 134 extending from the third upper vertical side plate first end 130 to the third upper vertical side plate second end 132 and generally perpendicular to the first and second upper vertical side plate lengths 106 and 122. In other words, as best seen in FIGS. 2-10, the third upper vertical side plate top 126 is preferably located below the tops 96, 112 of the first and second upper vertical side plate 92, 108 along the entire length 106, 122 of the first and second upper vertical side plates 92, 108. As best seen in FIGS. 2-10, the rafter bracket 10 may also include an upper cavity 136 defined by the first upper vertical side plate 92, second upper vertical side plate 108, third upper vertical side plate 124, and horizontal plate 52.

Optionally, purlins 11 extend between the rafters 16 and run the length of the building 10.

Preferably the vertical post 12 is located directly below the rafter 16 as shown in FIG. 2.

The first, second, and third upper vertical side plates 92, 108, 124, the horizontal plate 52 and the first, second, third and fourth lower vertical side plates 20, 36, 66, 78 may be discrete metal plates that are welded together. Alternatively, two or more of the first, second, and third upper vertical side plates 92, 108, 124, the horizontal plate 52 and the first, second, third and fourth lower vertical side plates 20, 36, 66, 78 may be integrally attached to each other, in the case of, for example, a rafter bracket 10 that is plastic and made by injection molding. The plates 20, 36, 66, 78, 92, 108, 124 and 52, especially the surfaces of the horizontal plate 52 and the first, second, third and fourth lower vertical side plates 20, 36, 66, 78 that face the vertical post 16 and the surfaces of the first and second upper vertical side plate 92 and 108 that face the rafter 16, are preferably flat so that they can rest against the vertical post 12 and rafter 16, which may be made out of wood.

Figure 4:
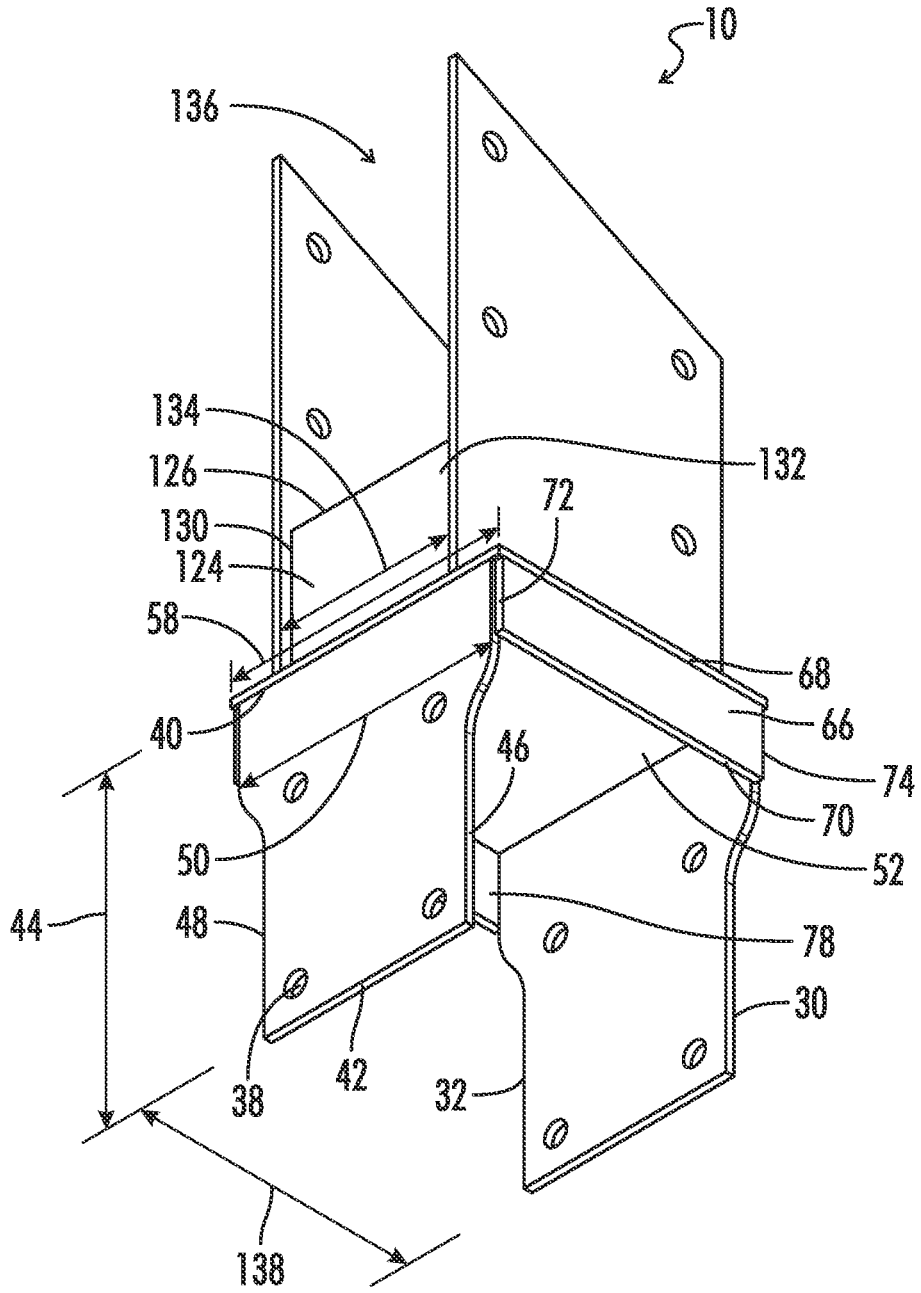
FIG. 4 is a bottom perspective view of the rafter bracket of FIG. 1.
Figure 6:
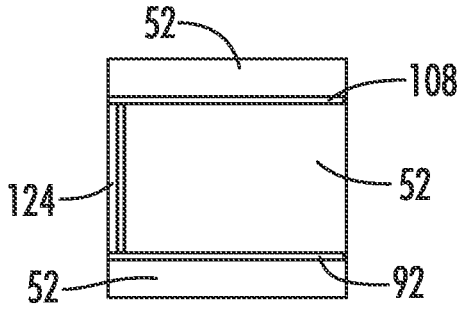
FIG. 6 is a top plan view of the rafter bracket of FIG. 1.
Figure 5:
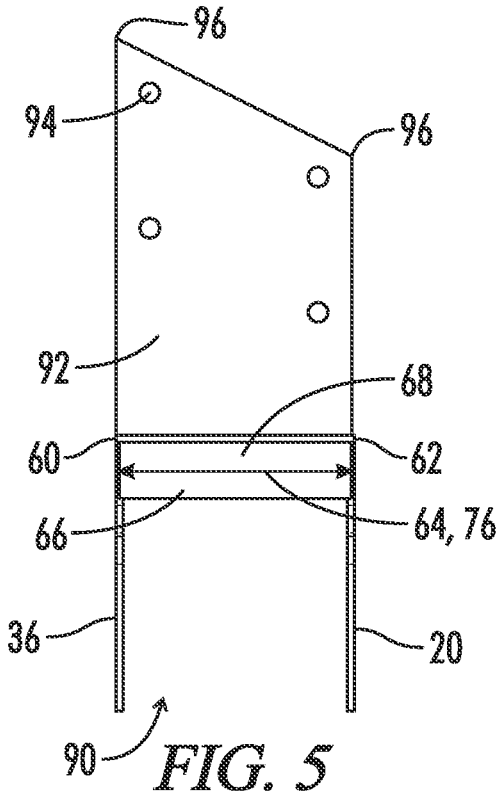
FIG. 5 is a side elevation view of the rafter bracket of FIG. 1.
Figure 8:
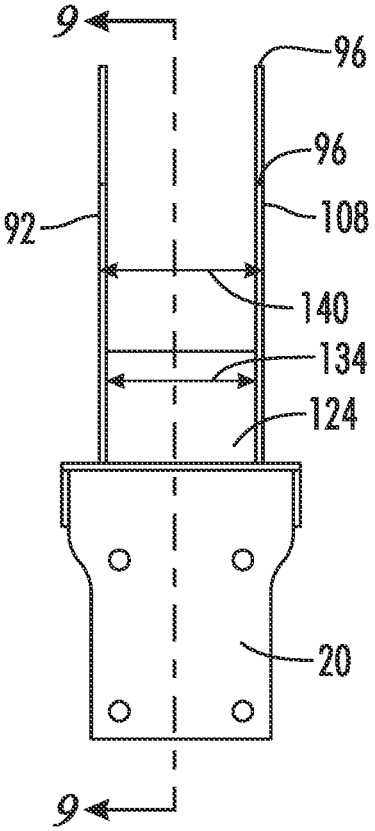
FIG. 8 is a side elevation view of the rafter bracket of FIG. 1.
Figure 7:
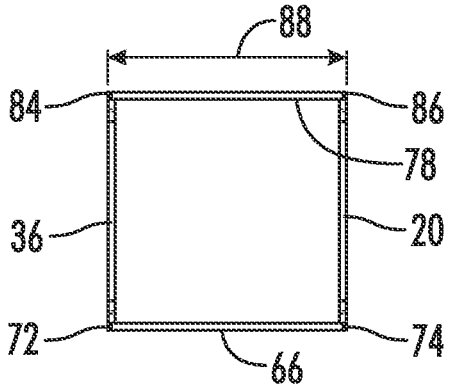
FIG. 7 is a bottom plan view of the rafter bracket of FIG. 1.
Figure 9:
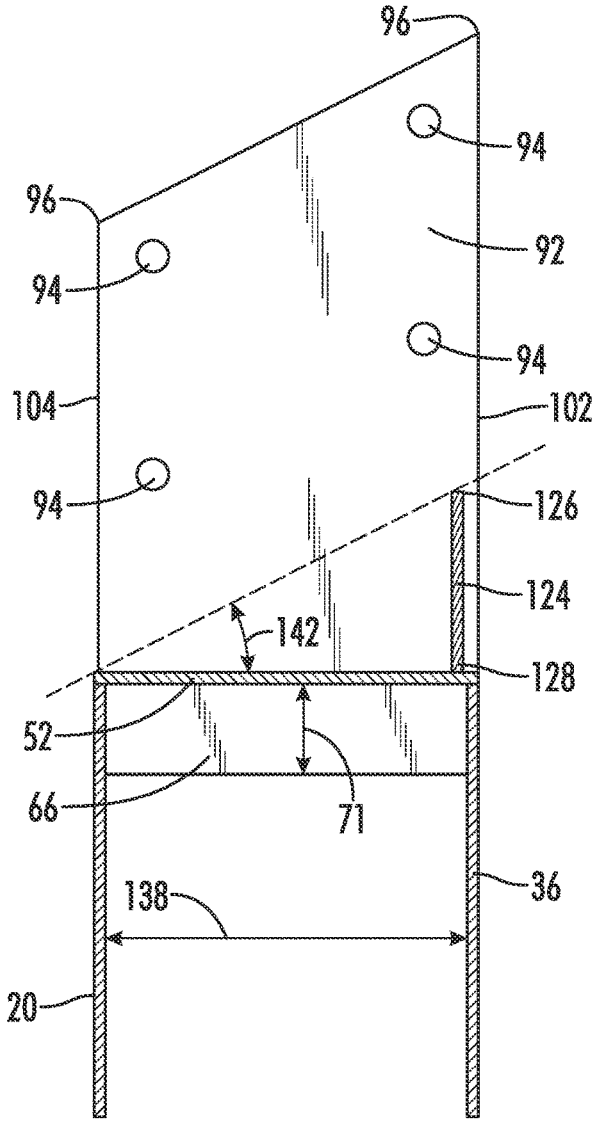
FIG. 9 is a side cross-sectional view of the rafter bracket of FIG. 1.
Figure 10:
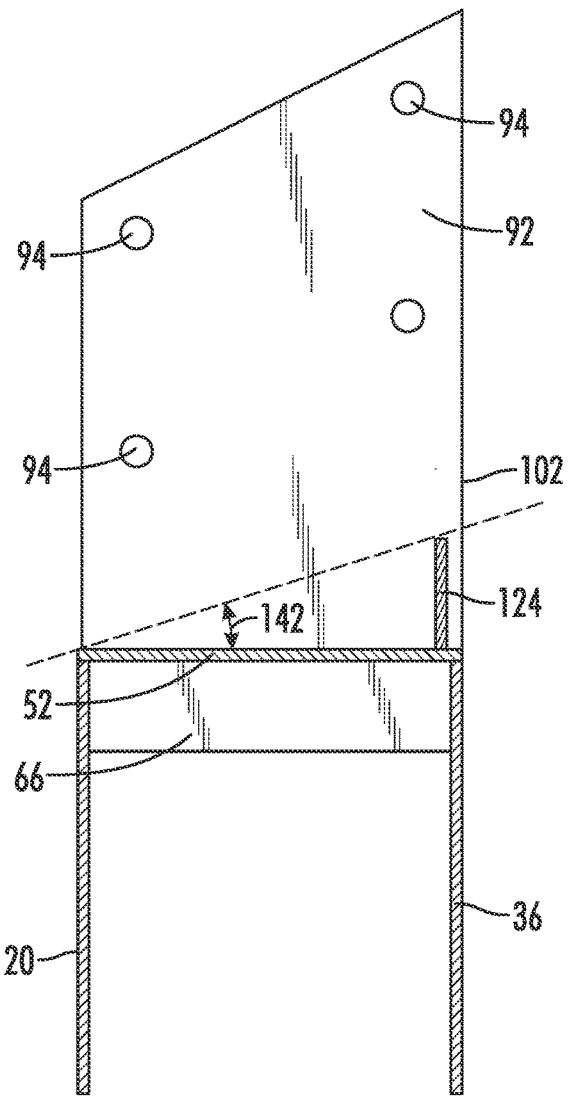
FIG. 10 is a side cross-sectional view of a rafter bracket of another embodiment of the present invention.

Optionally, as labelled in FIG. 4, the first lower vertical side plate 20 and second lower vertical side plate 36 are separated a first distance 138. The first distance 138 may be substantially constant along the first lower vertical side plate 20 and second lower vertical side plate 36 widths 34, 50 and the first distance 138 may be generally parallel to the horizontal plate length 64. Optionally, the first upper vertical side plate 92 and second upper vertical side plate 108 are separated a second distance 140, as labelled in FIG. 8. The second distance 140 may be substantially constant along the first upper vertical side plate 92 and second upper vertical side plate 108 lengths 106, 122 and the second distance 140 may be generally parallel to the horizontal plate width 58. In some but not all embodiments, the second distance 140 is less than the first distance 138. Optionally, as best seen in FIGS. 1 and 2, a vertical post 12 of a building 14 is positioned between the first, second, third and fourth lower vertical side plate 20, 36, 66, 78 in the lower cavity 90 and a rafter 16 of the building 14 is positioned on the third upper vertical side plate top 126 and between the first and second upper vertical side plates 92, 108. Optionally, as best seen in FIG. 2, at least one upper fastener 150 (such as a bolt, screw or lag) is positioned through a fastener aperture/hole 94 of the first upper vertical side plate 92, through the rafter 16 and then through the second upper vertical side plate 108, and at least one lower fastener 150 (such as a bolt, lag or screw) is positioned through a fastener aperture/hole 22 of the first lower vertical side plate 20, through the vertical post 12 and then through the second lower vertical side plate 36. Optionally, as best seen in FIGS. 2-10, the first lower vertical side plate 20 comprises a plurality of first lower vertical side plate fastener apertures/holes 22, the second lower vertical side plate 36 comprises a plurality of second lower vertical side plate fastener apertures/holes 38 aligned with the first lower vertical side plate fastener apertures/holes 22, the first upper vertical side plate 92 comprises a plurality of first upper vertical side plate apertures/holes 94, and the second upper vertical side plate comprises a plurality of second upper vertical side plate apertures/holes 110 aligned with the first upper vertical side plate fastener apertures/holes 94, and, as shown in FIG. 2, each fastener aperture/hole 22, 38, 94, 110 comprises a fastener 150. Optionally, as best seen in FIGS. 2-10, the first upper vertical side plate 92 comprises at least two upper vertical side plate fastener apertures/holes 94 adjacent to the first upper vertical side plate first end 102, the first upper vertical side plate 92 comprises at least two upper vertical side plate fastener apertures/holes 94 adjacent to the first upper vertical side plate second end 104, the second upper vertical side plate 108 comprises at least two upper vertical side plate fastener apertures/holes 110 adjacent to the second upper vertical side plate first end 118, the second upper vertical side plate 108 comprises at least two second upper vertical side plate fastener apertures/holes 110 adjacent to the second upper vertical side plate second end 120, the third upper vertical side plate 124 is adjacent to the first and second upper vertical side plate first ends 102, 118, at least one first upper vertical side plate fastener aperture/hole 94 adjacent to the first upper vertical side plate first end 102 is above all of the first upper vertical side plate fastener apertures/holes 94 adjacent to the first upper vertical side plate second end 105, at least one second upper vertical side plate fastener aperture/hole 110 is above all of the second upper vertical side plate fastener apertures/holes 110 adjacent to the second upper vertical side plate second end 118, and as best seen in FIG. 2, the rafter 16 extends upwardly at an acute angle 142 (preferably of less than 60, more preferably less than 45 degrees) relative to the first and second upper vertical side plate heights 100, 116 from the first and second upper vertical side plate second ends 104, 120 to the first and second upper vertical side plate first ends 102, 118. Optionally, as best seen in FIGS. 2-10, the rafter bracket 10 is open opposite the third upper vertical side plate 124 and the third upper vertical side plate 1248 is adjacent to the first and second upper vertical side plate first ends 102, 118. Optionally, as best seen in FIGS. 2-10, the first and second upper vertical side plates 92, 108 each comprise a variable height 100, 116, the first upper vertical side plate 92 tapers in decreasing height from the first upper vertical side plate first end 102 to the first upper vertical side plate second end 104 and the second upper vertical side plate 108 tapers in decreasing height from the second upper vertical side plate first end 118 to the second upper vertical side plate second end 120. Optionally, as shown in FIGS. 2-10, the at least two upper vertical side plate fastener apertures/holes 94, 110 adjacent to the first upper vertical side plate first end 102 are aligned in a first vertical row generally parallel to the first upper vertical side plate height 100, the at least two upper vertical side plate fastener apertures/holes 94, 110 adjacent to the first upper vertical side plate second end 104, are aligned in a second vertical row generally parallel to the first upper vertical side plate height 100, the at least two upper vertical side plate fastener apertures/holes 94, 110 adjacent to the second upper vertical side plate first end 118 are aligned in a first vertical row generally parallel to the second upper vertical side plate height 116, and the at least two second upper vertical side plate fastener apertures/holes 94, 110 adjacent to the second upper vertical side plate second end 120 are aligned in a first vertical row generally parallel to the first upper vertical side plate height 100.

Optionally, the vertical post 12, which may be a wall stud, comprises a vertical post 12 top end 154 located in the lower cavity 90, a vertical post bottom end 158, a vertical post height 152 extending from the vertical post top end 154 to the vertical post bottom end 158 and generally parallel to the first and second lower vertical side plate heights 28, 44 and the first and second upper vertical side plate heights 100, 116, wherein the rafter 16 comprises a rafter first end 144, a rafter second end 146, and a rafter length 148 extending from the rafter first end 144 to the rafter second end 146, and further wherein the rafter length 148 is angled relative to the vertical post height 152 and the first and second upper vertical side plate heights 28, 44 at an angle 142 less than 60 degrees.

Optionally, in some embodiments, as best seen in FIGS. 2-10, the first and second upper vertical side plates 92, 108 are oriented approximately 90 degrees relative to the first and second lower vertical side plates 20, 36, and the third upper vertical side plate 124 is oriented approximately 90 degrees relative to the third and fourth lower vertical side plates 66, 78. In other words, as shown in FIGS. 2-10, the first distance 138 in some embodiments is generally perpendicular to the second distance 140, and the first and second upper vertical side plate lengths 106, 122 are generally perpendicular to the first and second lower vertical side plate widths 34, 50.

Optionally, as best seen in FIGS. 2-10, the first and second upper vertical side plates 90, 108 are substantially mirror images of each other and further wherein the first and second lower vertical side plates 20, 36 are substantially mirror images of each other. In other words, the first and second upper vertical side plates 90, 108 may be substantially the same size and shape and may have the same fastener aperture/hole 94, 110 patterns and the first and second lower vertical side plates 20, 36 may be substantially the same size and shape and may have the same fastener aperture/hole 22, 38 patterns.

Optionally, as best seen in FIGS. 2-10, the third and fourth lower vertical side plates 66, 78 extend between the first lower vertical side plate 20 and the second lower vertical side plate 36, and the third upper vertical side plate 124 extends between the first upper vertical side plate 92 and the second upper vertical side plate 102.

Optionally, as best seen in FIGS. 2-10, the third 66 and fourth 78 lower vertical side plate heights 71, 83 are less than the first and second lower vertical side plate heights 28, 44.

Optionally, as best seen in FIGS. 2-10, the first and second lower vertical side plates 20, 36 each comprise a variable width 34, 50 with a wider portion and a narrower portion and the third and fourth lower vertical side plates 66, 78 extend between the first and second lower vertical side plate 20, 36 wider portions.

Optionally, as best seen in FIGS. 2-10, the third upper vertical side plate top 126 is generally flat as it extends between the first and second upper vertical side plates 92, 108.

Optionally, as best seen in FIGS. 2-10, the lower cavity 90 is generally rectangular in shape.

Optionally, as best seen in FIGS. 2-10, the first and second lower vertical side plate tops 24, 40 are attached to the horizontal plate 52 and further wherein the first, second, and third upper vertical side plate bottoms 98, 114, 128 are attached to the horizontal plate 52. Optionally, as best seen in FIGS. 2-10, the third and fourth lower vertical side plate heights 71, 83 are less than the first and second lower vertical side plate heights 28, 44 (e.g., the third and fourth lower vertical side plate heights 71, 83 may be ⅓ or less of the first and second lower vertical side plate heights 28, 44) and the third upper vertical side plate height 135 is no more than about ⅓ the median height of the first and second upper vertical side plate 92, 108. Thus, as best seen in FIGS. 2-10, the third and fourth lower vertical side plate 66, 78 may be a short ledge that extends below the horizontal plate 52 and the third upper vertical side plate 124 may be a short ledge that extends above the horizontal plate 52.

Optionally, as best seen in FIG. 2, the rafter 16 is also positioned on the horizontal plate 52.

The Embodiments of FIGS. 11-29

FIGS. 11-29 show an alternate version of the rafter bracket 10 of FIGS. 1-10. The primary difference between the rafter bracket 10 of FIGS. 1-10 and the rafter bracket 10 of FIGS. 11-29 is that the rafter bracket of FIGS. 11-29 includes lateral plates (namely, side lateral plates 162 and bottom lateral plates 166) that are attached to one or more of the first, second, third and fourth lower vertical side plates 20, 36, 66, and 78 and extend away from the lower cavity 90 and define a lateral cavity 164 in which a beam 172 is positioned. In some embodiments, all of the first, second, third and fourth lower vertical side plates 20, 36, 66, and 78 include side lateral plates 162 and bottom lateral plates 166. In other embodiments, not all of the first, second, third and fourth lower vertical side plates 20, 36, 66, and 78 include side lateral plates 162 and bottom lateral plates 166. Preferably at least the second, third and/or fourth lower vertical side plates 36, 66, and 78 include side lateral plates 162 and bottom lateral plates 166. Again, the word "attached" embraces welding as well as parts that are integrally attached. The side lateral plates 162 may be supported by braces 168, which may support adjacent side lateral plates 162 as best seen in FIGS. 13 and 22 and may include one or more aligned fastener apertures 170 for receiving a fastener 150. The bottom lateral plates 166 may be supported by braces 168 which may be generally triangular in shape and located below the respective bottom lateral plate 166 and may be attached to the bottom of the bottom lateral plate 166 and the respective first, second, third and fourth lower vertical side plates 20, 36, 66, and 78, as best seen in FIGS. 13, and 16-21, and the bottom lateral plates 166 may include fastener apertures 174 for receiving a fastener 150. The bracket 10 of FIGS. 11-29 may include one or more features of the bracket 10 of FIGS. 1-10. The side lateral plates 162 and bottom lateral plates 166 preferably contact, and more preferably are flush against, the beam 172 due to the use of the fasteners 150, however other embodiments are possible.

Optionally, the lateral cavity 164 has an open top, as best seen in FIGS. 13-14 and 22-23, and the plurality of lateral plates 162 and 166 border the beam 172 on two sides and the bottom.

Optionally, as best seen in FIGS. 13-14 and 22-23, the plurality of lateral plates comprise first and second side lateral plates 162, the first and second side lateral plates 162 oriented generally parallel to each other and defining opposite sides of the lateral cavity 164 and bordering the beam 172 on two sides, each of the first and second side lateral plates 162 having a height generally parallel to the first and second upper vertical side plate heights 100 and 116. Optionally, the respective first, second, third or fourth lower vertical side plate comprising the plurality of lateral plates 20, 36, 66, and 78 border the beam 172 on a third side, as best seen in FIGS. 13, 14, 22 and 23.

Figure 20:
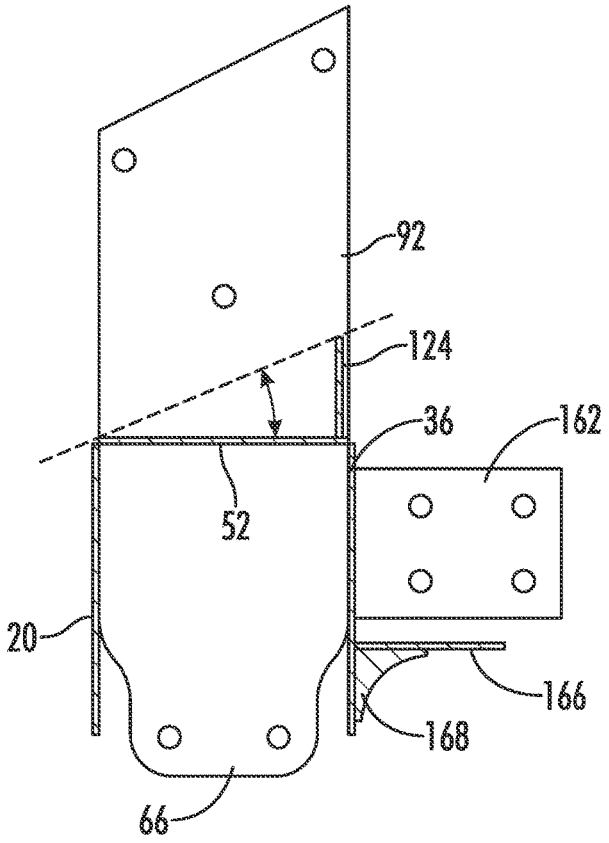
FIG. 20 is a side cross-sectional view of the rafter bracket of FIG. 1.
Figure 21:
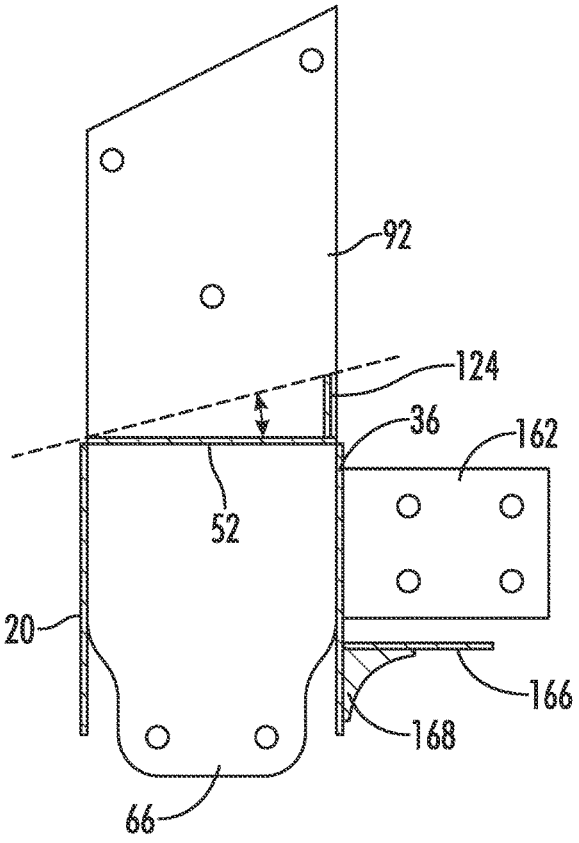
FIG. 21 is a side cross-sectional view of a rafter bracket of another embodiment of the present invention.
Figure 22:
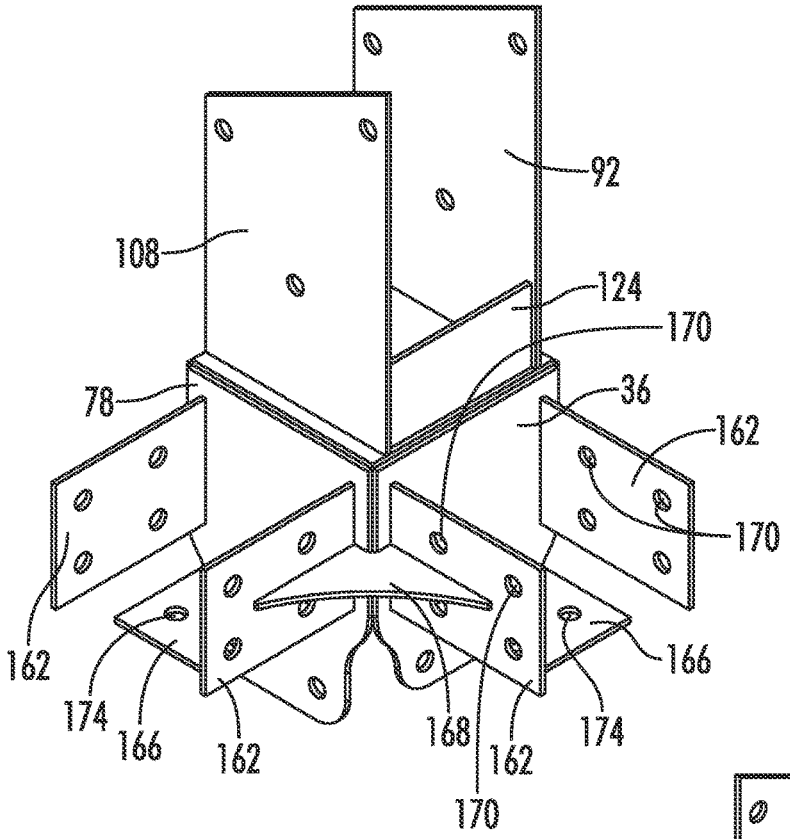
FIG. 22 is a side perspective view of a rafter bracket of another embodiment of the present invention.

Optionally, the bottom lateral plate(s) 166 are generally parallel to the horizontal plate 52, as best seen in FIGS. 20-21.

Optionally, the plurality of lateral plates 162 and 166 are not directly attached to each other.

Optionally, each of the plurality of lateral plates 162 and 166 comprise a lateral plate fastener aperture 170 and 174 and fasteners 150 are positioned through the lateral plate fastener apertures 170 and 174 and through the beam(s) 172.

Optionally, a plurality of the first, second, third and fourth lower vertical side plates 20, 36, 66, and 78 each comprise a plurality of lateral plates 162 and 166 extending laterally away from the respective lower vertical side plate 20, 36, 66, and 78 and lower cavity 90 and creating a lateral cavity 164, wherein a beam 172 is located in each lateral cavity 164 and further wherein, for each the first, second, third and fourth lower vertical side plate 20, 36, 66, and 78 comprising a plurality of lateral plates 162 and 166, at least one of the plurality of lateral plates 162 and 166 comprises a fastener aperture 170 and 174, and a fastener 150 is positioned through at least one lateral plate fastener aperture 170 and 174 and through a beam 172.

Optionally, the rafter bracket 10 further includes a brace 168 extending between and attached to a side lateral plate 162 of one of the first, second, third and fourth lower vertical side plates 20, 36, 66, and 78 and a side lateral plate 162 of another of the first, second, third and fourth lower vertical side plates 20, 36, 66, and 78, as best seen in FIGS. 13, 15, 19 and 22 for example. The brace 168 may be generally triangular in shape, as best seen FIGS. 13 and 22 for example.

Optionally, the third upper vertical side plate 124 is adjacent to the first and second upper vertical side plate first ends 102 and 118, and the rafter 16 extends upwardly at an acute angle relative to the first and second upper vertical side plate heights 100 and 116 from the first and second upper vertical side plate second ends 104 and 120 to the first and second upper vertical side plate first ends 102 and 118.

Figure 12:
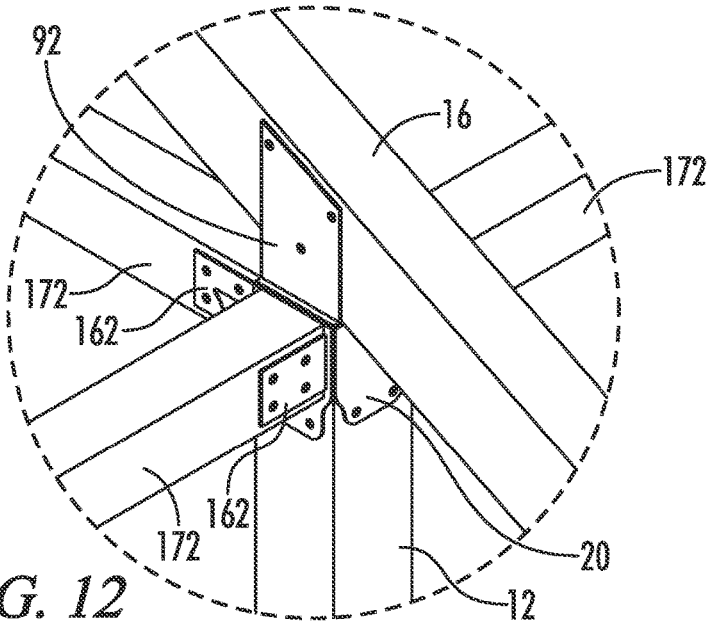
FIG. 12 is a close-up side perspective view of the circled area labelled 12 in FIG. 11 to better show the rafter bracket.
Figure 13:
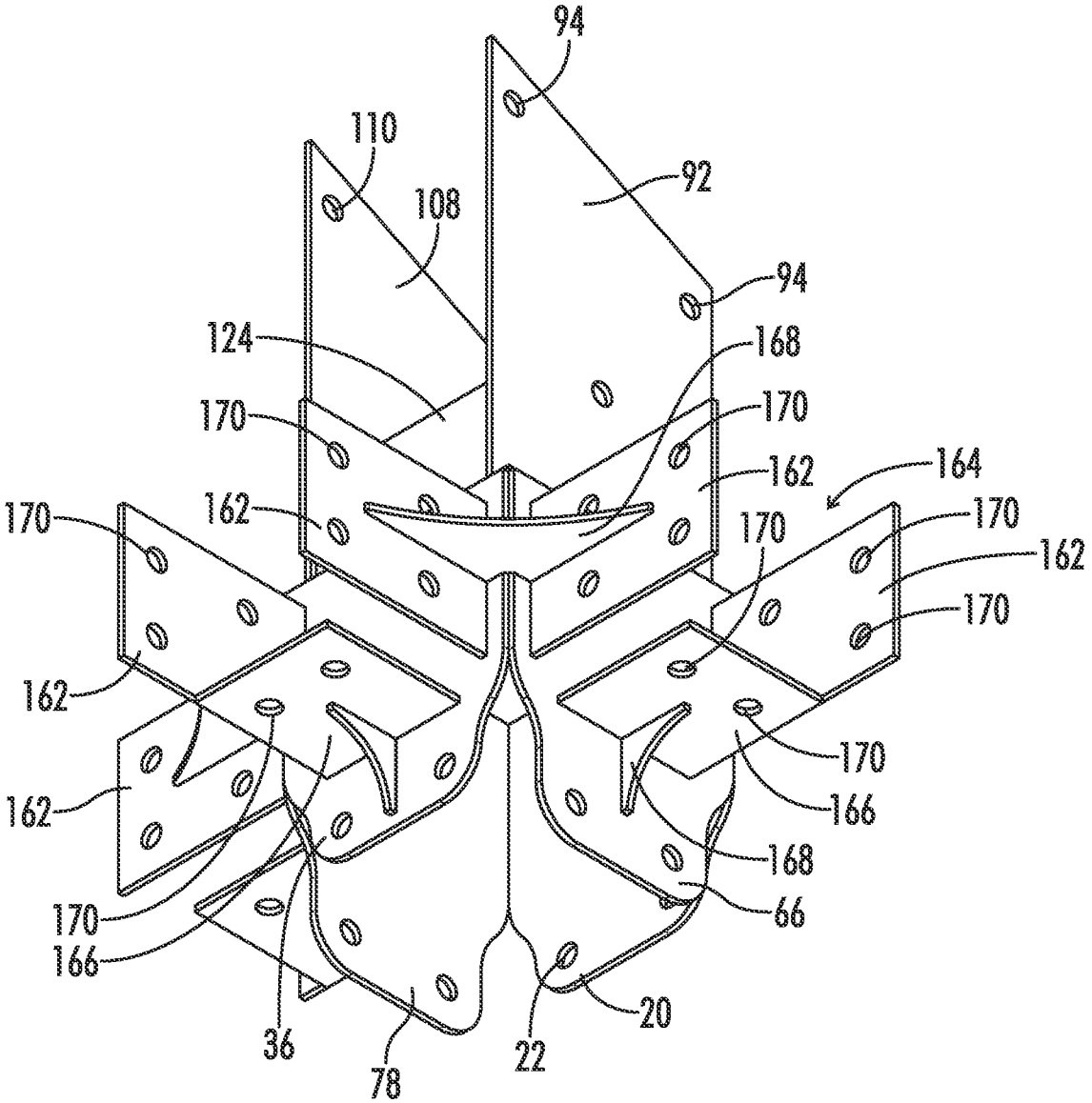
FIG. 13 is a bottom perspective view of the rafter bracket of FIG. 10
Figure 14:
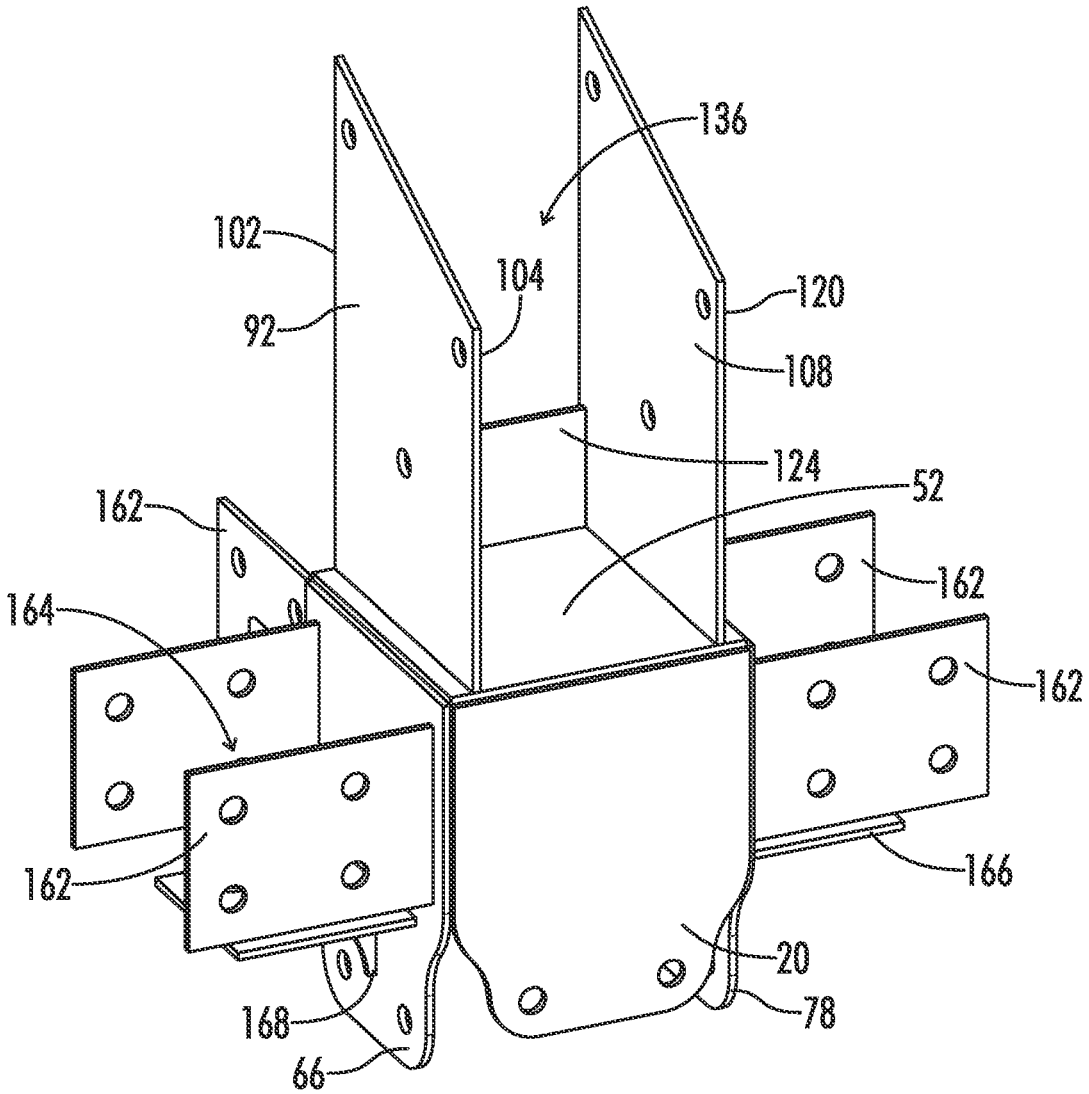
FIG. 14 is a side perspective view of the rafter bracket of FIG. 10.
Figure 15:
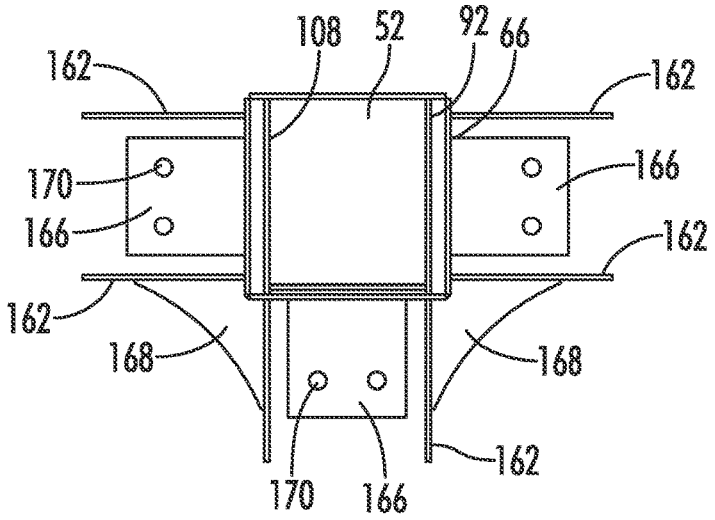
FIG. 15 is a top plan view of the rafter bracket of FIG. 10.
Figure 16:
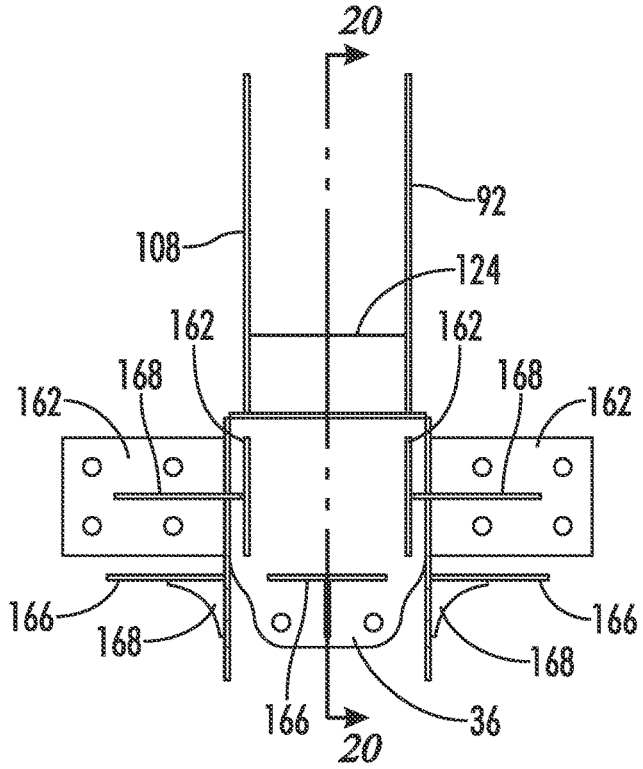
FIG. 16 is a side elevation view of the rafter bracket of FIG. 10.
Figure 17:
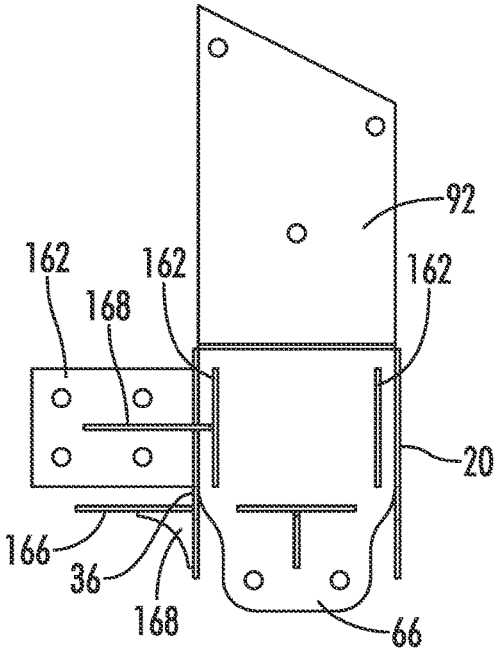
FIG. 17 is another side elevation view of the rafter bracket of FIG. 10.
Figure 18:
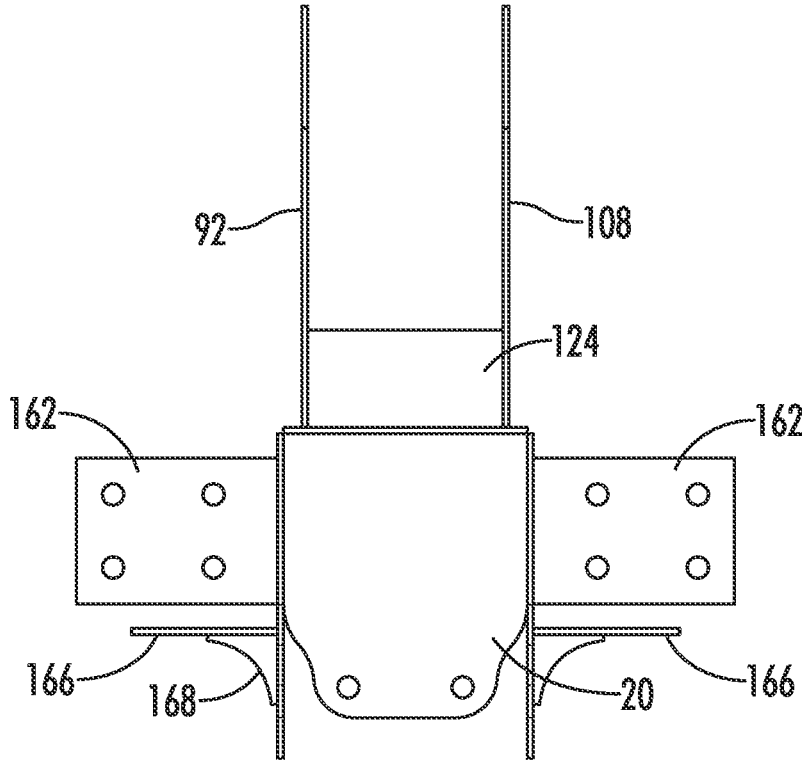
FIG. 18 is another side elevation view of the rafter bracket of FIG. 10.
Figure 19:
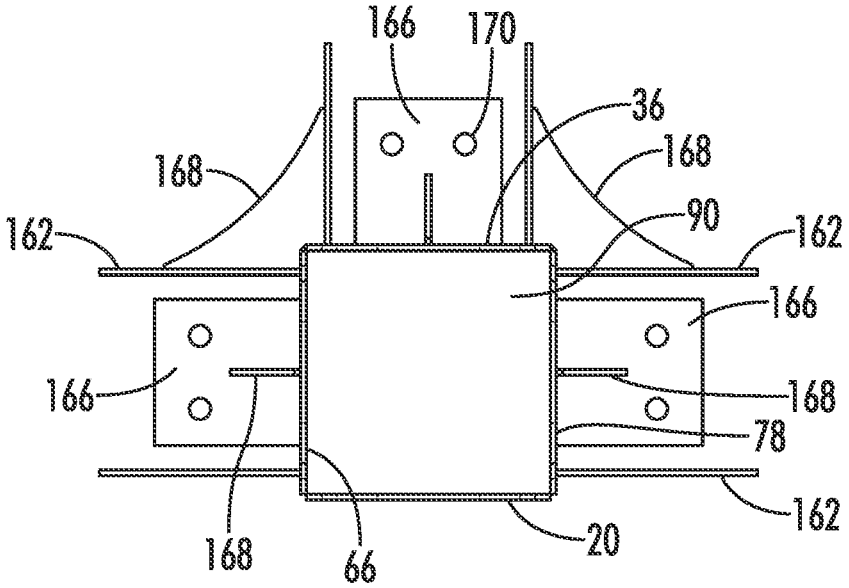
FIG. 19 is a bottom plan view of the rafter bracket of FIG. 10.

Optionally, one of the beams 172 and the vertical post 12 are located directly below the rafter 16, as best seen in FIG. 12.

Figure 23:
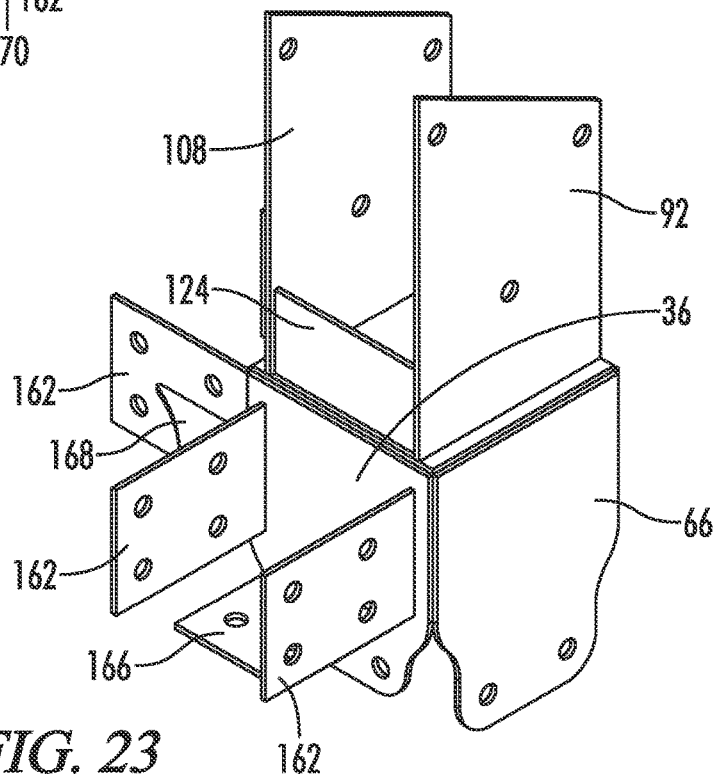
FIG. 23 is a side perspective view of a rafter bracket of another embodiment of the present invention.
Figure 24:
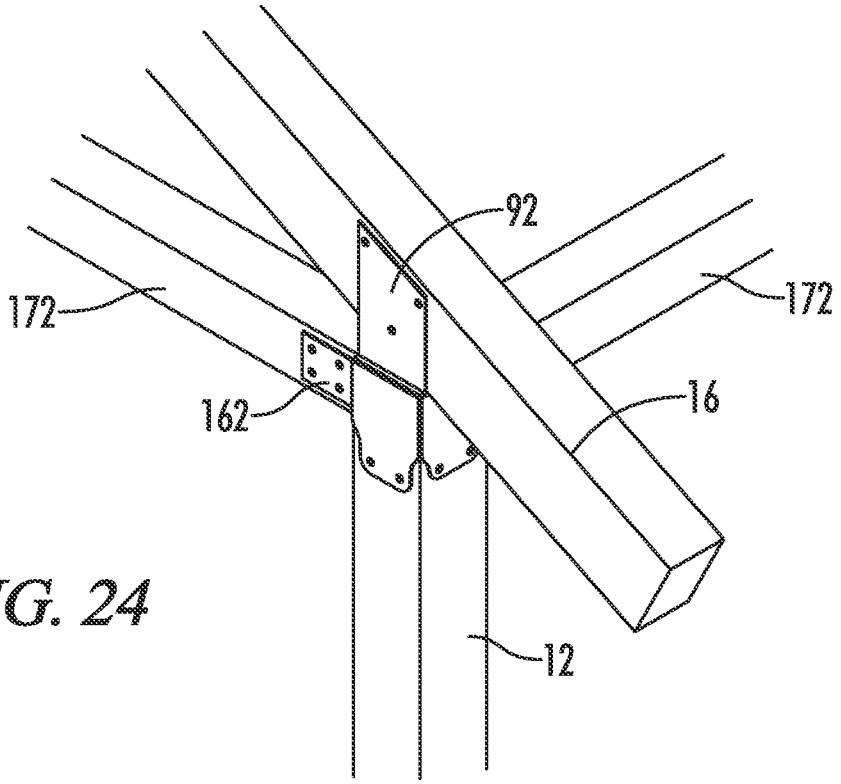
FIG. 24 is a side elevation view of the rafter bracket of FIG. 22 in use connecting a rafter to a vertical post and two beams.
Figure 25:
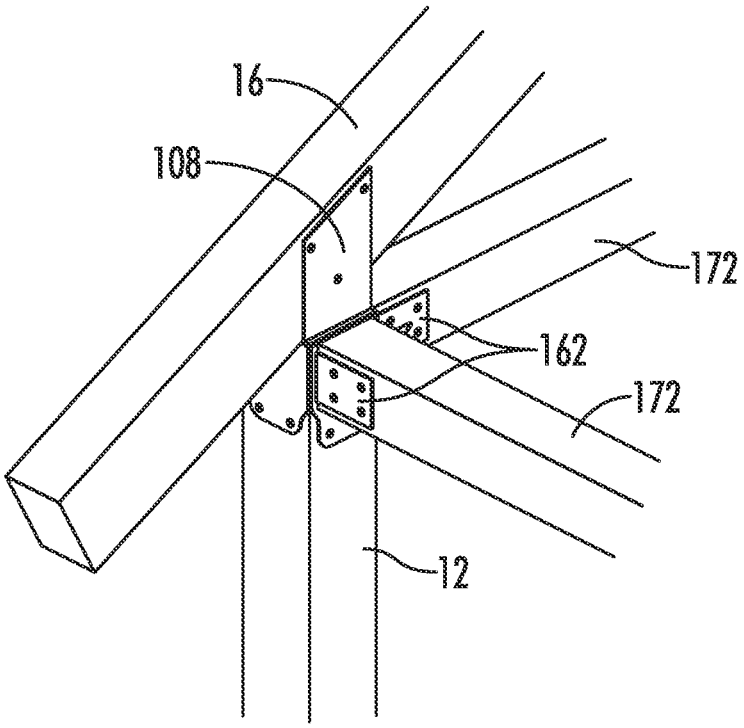
FIG. 25 is another side elevation view of the rafter bracket of FIG. 22 in use connecting a rafter to a vertical post and two beams.
Figure 26:
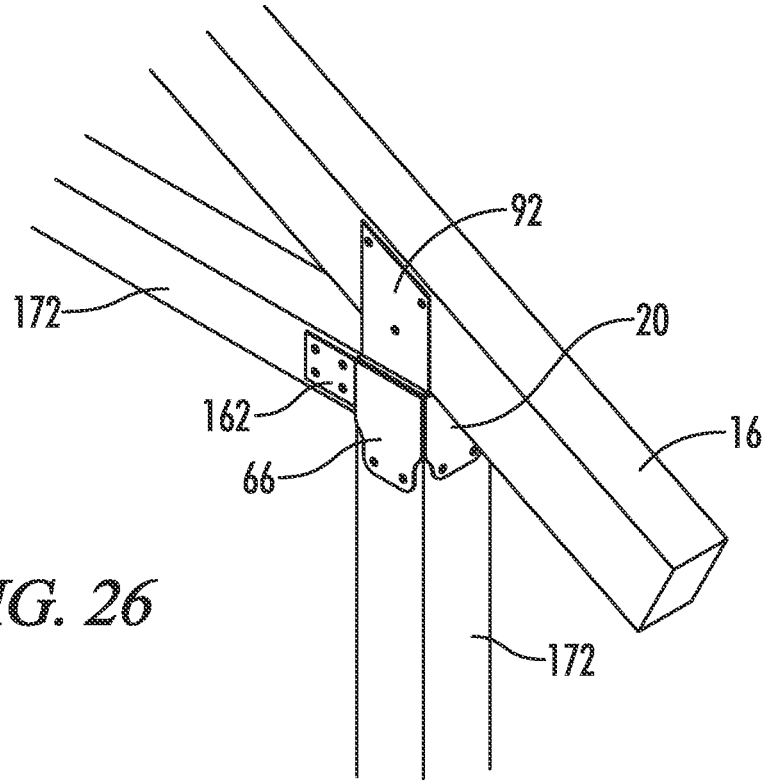
FIG. 26 is a side elevation view of a rafter bracket of another embodiment of the present invention in use connecting a rafter to a vertical post and beam.
Figure 27:
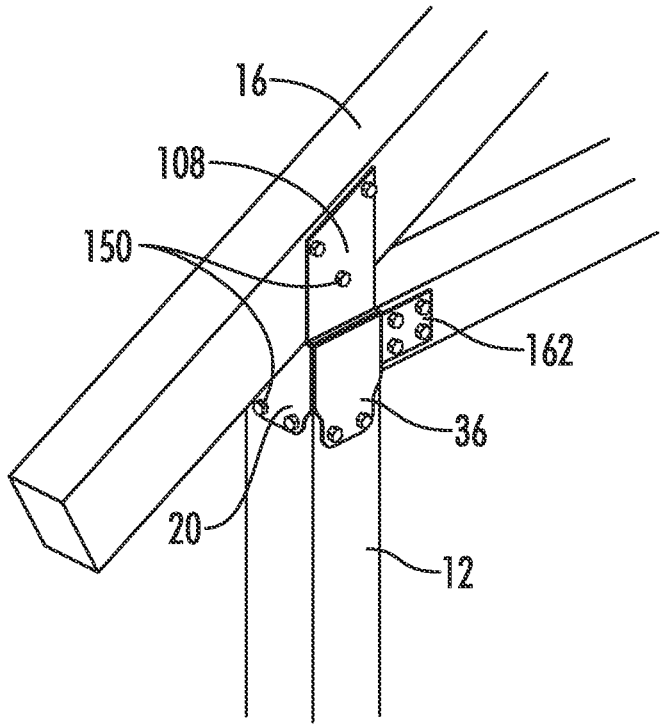
FIG. 27 is a side elevation view of the rafter bracket of FIG. 26 in use connecting a rafter to a vertical post and beam and with fasteners located in the fastener holes.

Optionally, the rafter bracket 10 is open opposite the third upper vertical side plate 124 and one of the lateral cavities 164 is located below and adjacent to the third upper vertical side plate 124, as best seen in FIG. 23 for example.

Optionally, one of the beams 172 and the rafter 16 are located in the same plane, as shown in FIGS. 12, and 24-27 and 29.

Optionally, the vertical post 12 comprises a vertical post top end 154 located in the lower cavity 90, a vertical post bottom end 158, a vertical post height 152 extending from the vertical post top end 154 to the vertical post bottom end 158 and generally parallel to the first and second lower vertical side plate heights 28 and 44 and the first and second upper vertical side plate heights 100 and 116, the rafter 16 comprises a rafter first end 144, a rafter second end 146, and a rafter length 148 extending from the rafter first end 144 to the rafter second end 146, and the rafter length 148 is angled relative to the vertical post height 152 and the first and second upper vertical side plate heights 100 and 116 at an angle less than 60 degrees, and the beam 160 is generally perpendicular to the vertical post 12.

Optionally, the first and second upper vertical side plates 92 and 108 are oriented approximately 90 degrees relative to the first and second lower vertical side plates 20 and 36, and the third upper vertical side plate 124 is oriented approximately 90 degrees relative to the third and fourth lower vertical side plates 66 and 78 and the first or second lower vertical side plate 20 or 36 comprise the plurality of lateral plates 162 and 166.

Optionally, the third upper vertical side plate top 126 extends between the first and second upper vertical side plates 92 and 108 and is generally flat as it extends between the first and second upper vertical side plates 92 and 108.

Optionally, the lower cavity 90 and the lateral cavity 164 are generally rectangular in shape.

Optionally, the vertical post 12 is a wall stud of the building 14.

Optionally, the rafter 16 is also positioned on the horizontal plate 52.

Optionally, the lateral cavity 164 is configured to allow a beam 172 to extend generally perpendicular to the first, second, third and fourth lower vertical side plate heights 28, 44, 71, and 83.

Figure 11:
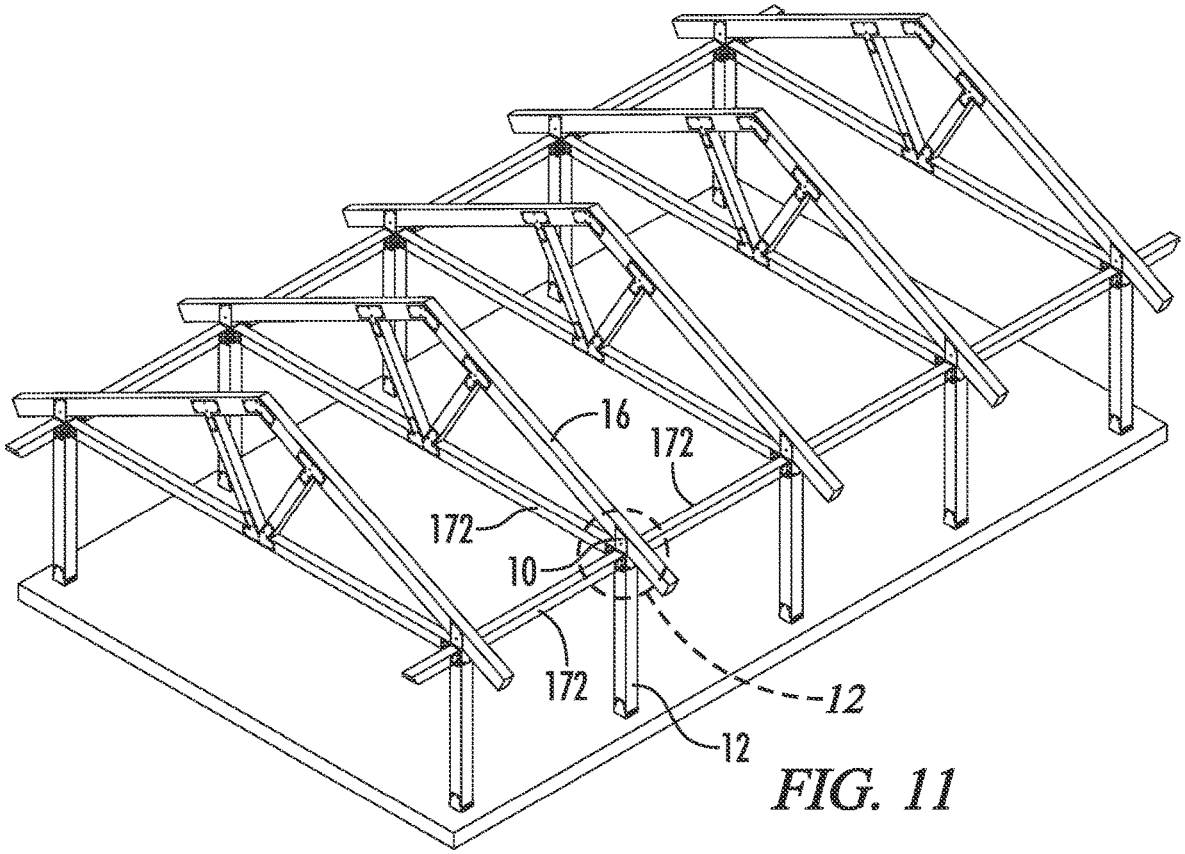
FIG. 11 is a side perspective view of a building utilizing the rafter bracket of FIG. 10.
Figure 28:
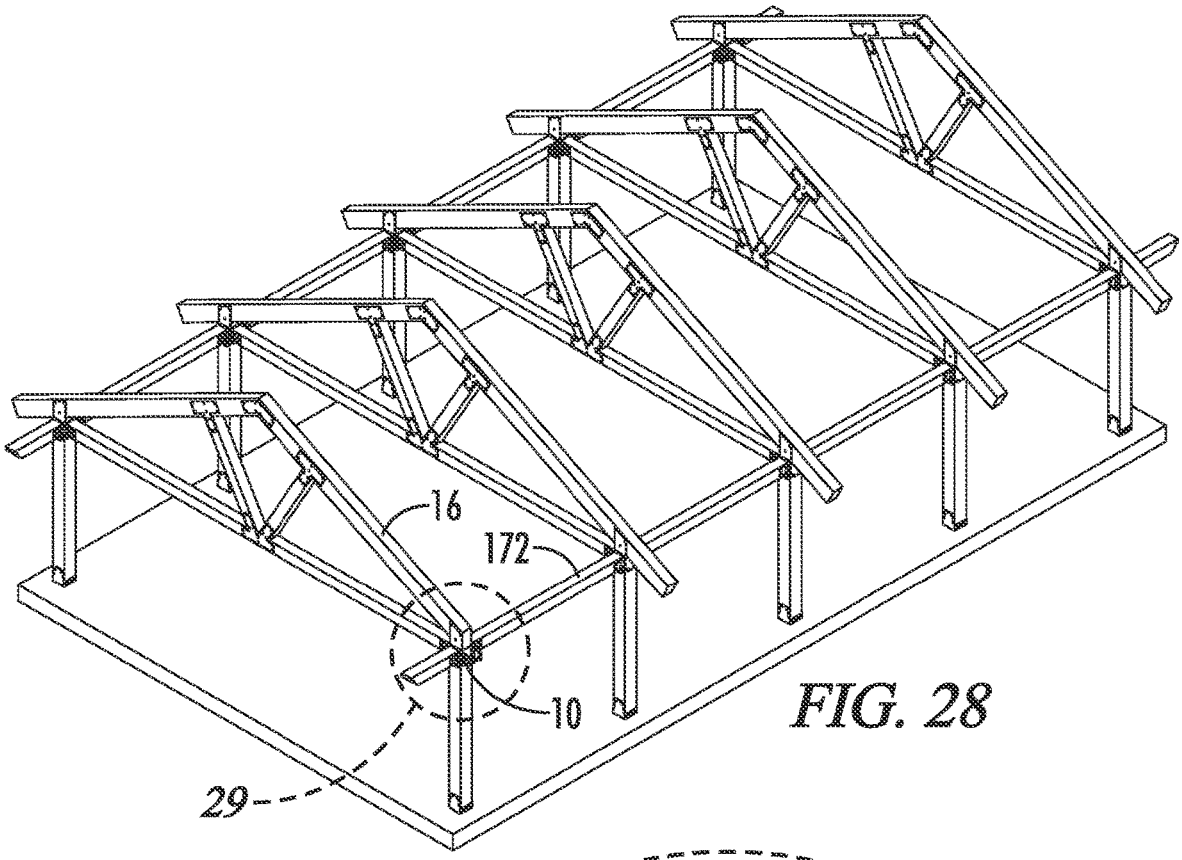
FIG. 28 is a side perspective view of a building utilizing a rafter bracket of another embodiment of the present invention.
Figure 29:
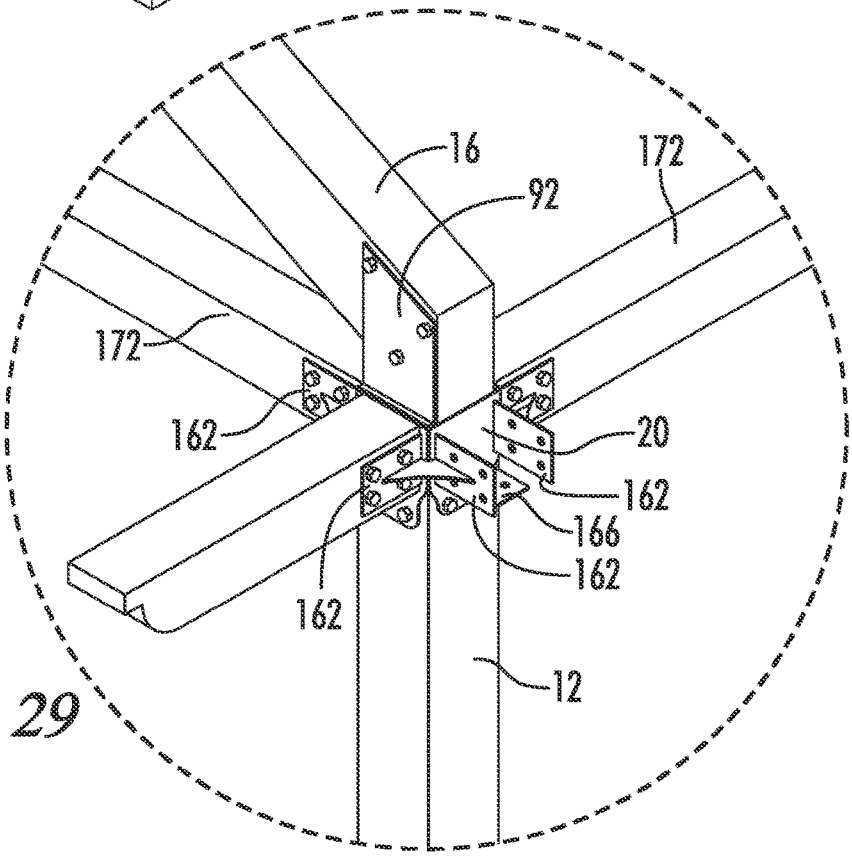
FIG. 29 is a close-up side perspective view of the circled area labelled 29 in FIG. 28 to better show the rafter bracket.

It will be understood that the building 14 will generally include a plurality of rafters 14, vertical posts 12 and beams 172, as shown in FIGS. 1, 11, and 28 for example.

The Embodiments of FIGS. 30-39

FIGS. 30-39 show an alternate version of the rafter bracket 10 of FIGS. 1-29. In FIGS. 30-39, the rafter 16 sits on an upper plate top surface 196, as opposed to resting in an upper cavity, as explained below.

Figure 30:
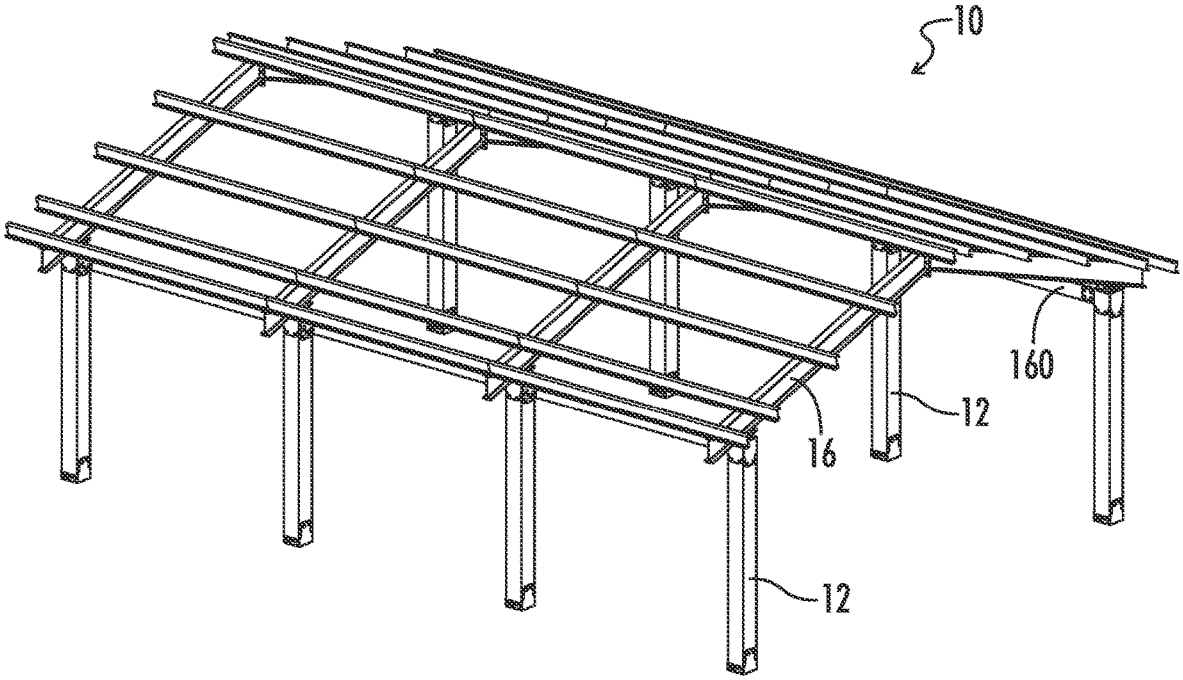
FIG. 30 is a side perspective view of a building utilizing a rafter bracket of another embodiment of the present invention.
Figure 31:
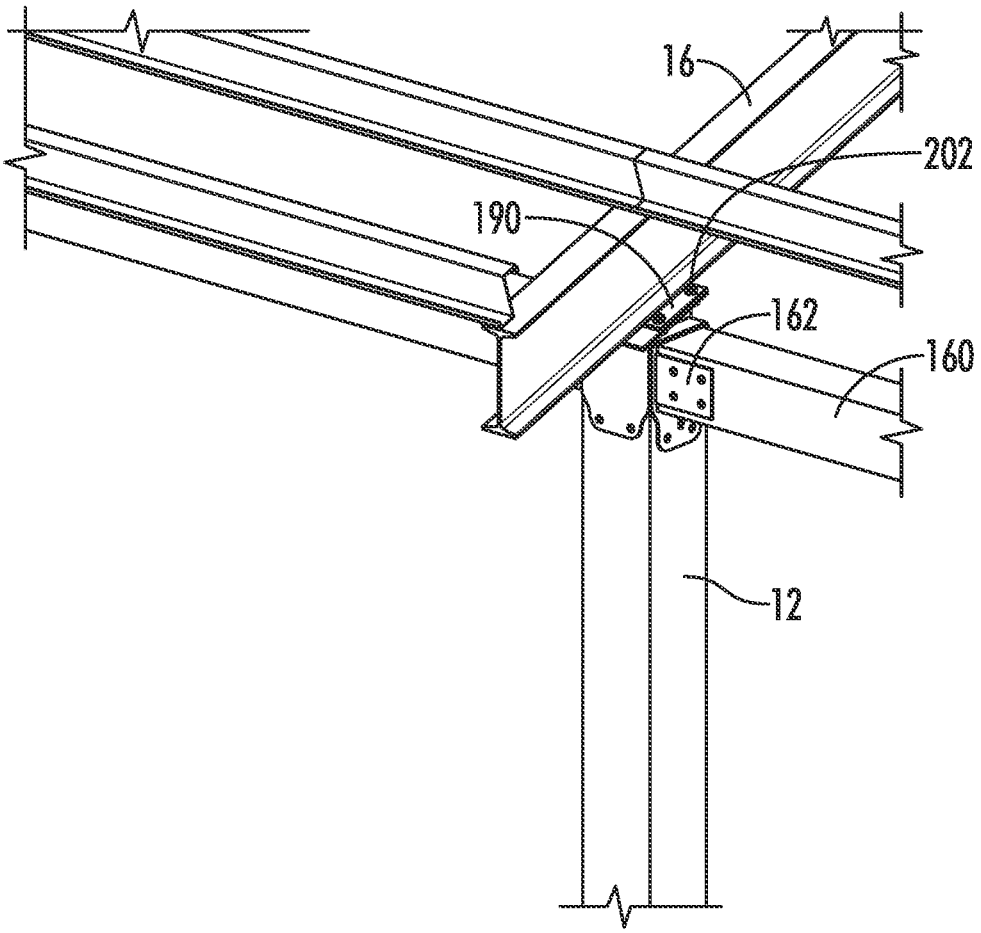
FIG. 31 is a side perspective view of the building and rafter bracket of FIG. 30.
Figure 32:
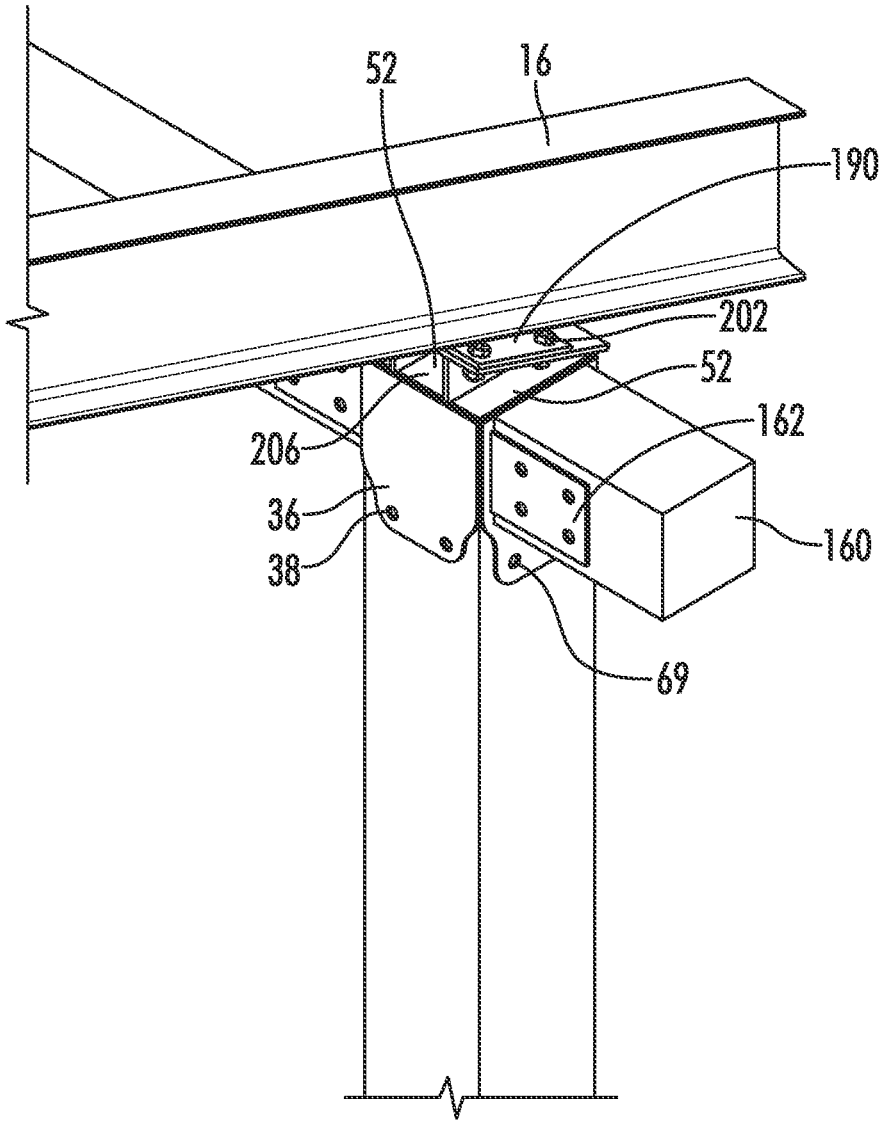
FIG. 32 is a side perspective view of the building and rafter bracket of FIG. 30.
Figure 33:
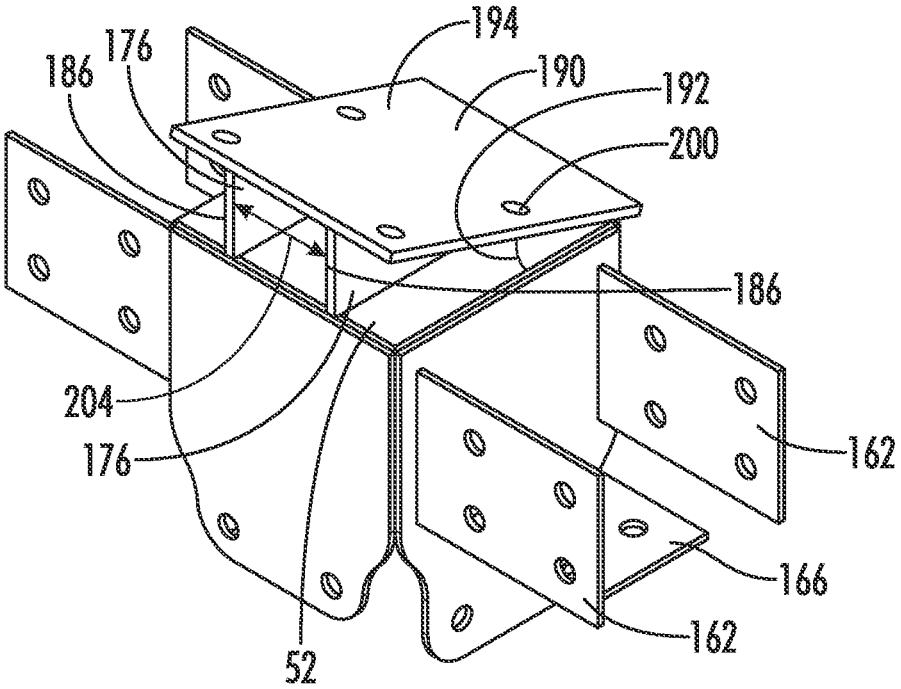
FIG. 33 is a side perspective view of the rafter bracket of FIG. 30.
Figure 34:
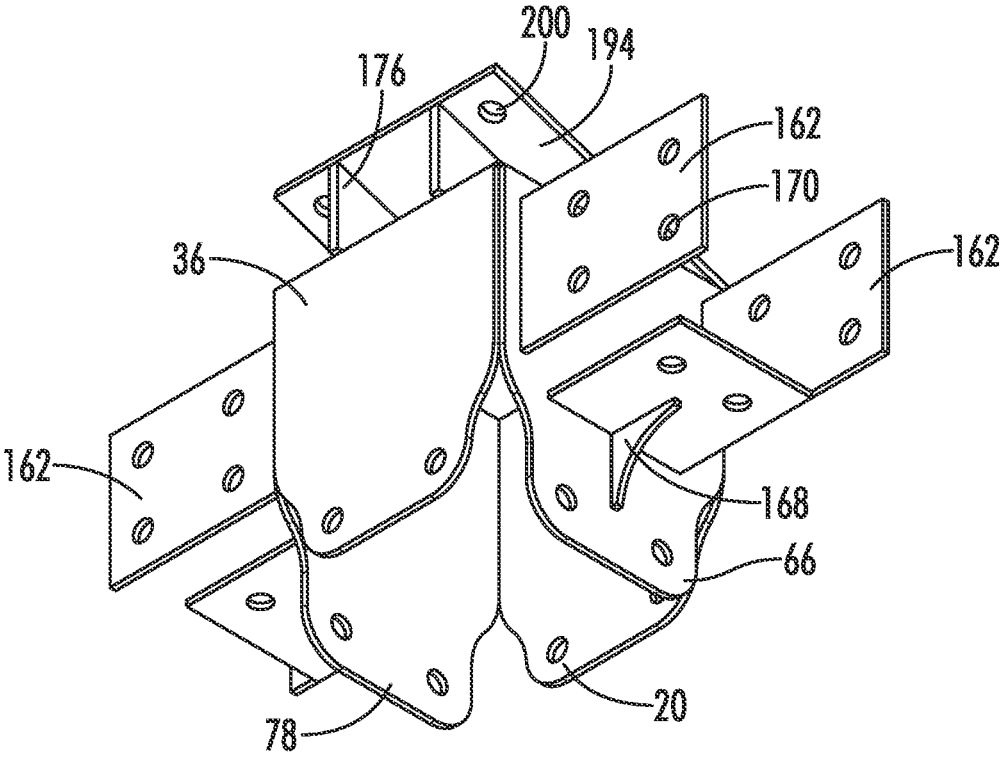
FIG. 34 is a bottom perspective view of the rafter bracket of FIG. 30.
Figure 35:
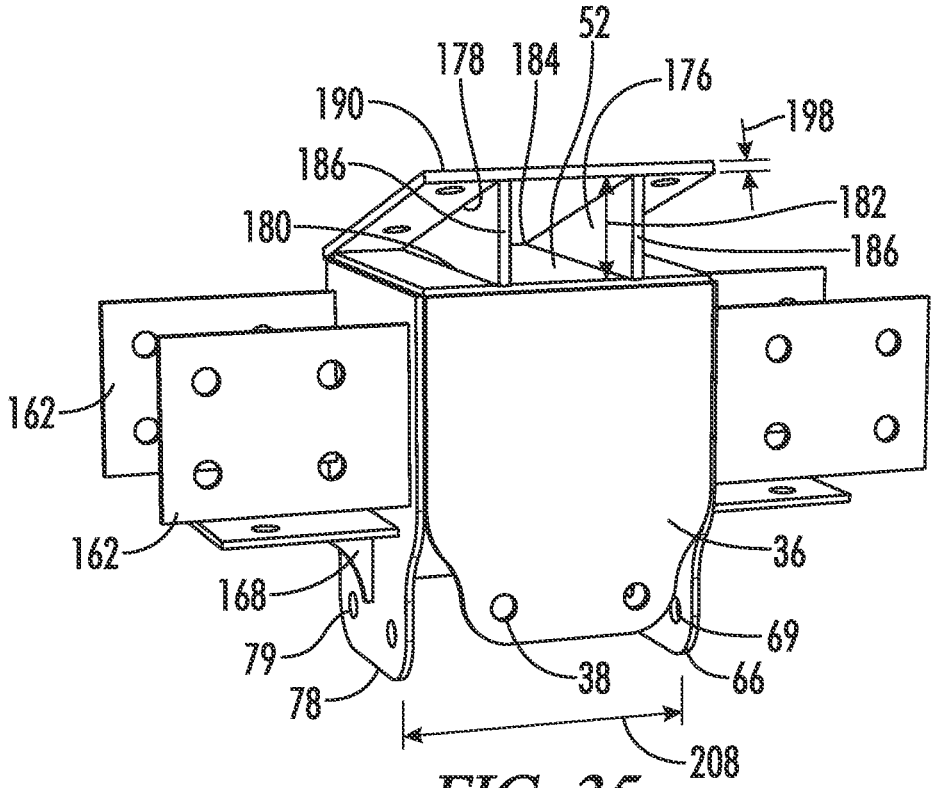
FIG. 35 is a side perspective view of the rafter bracket of FIG. 30.
Figure 36:
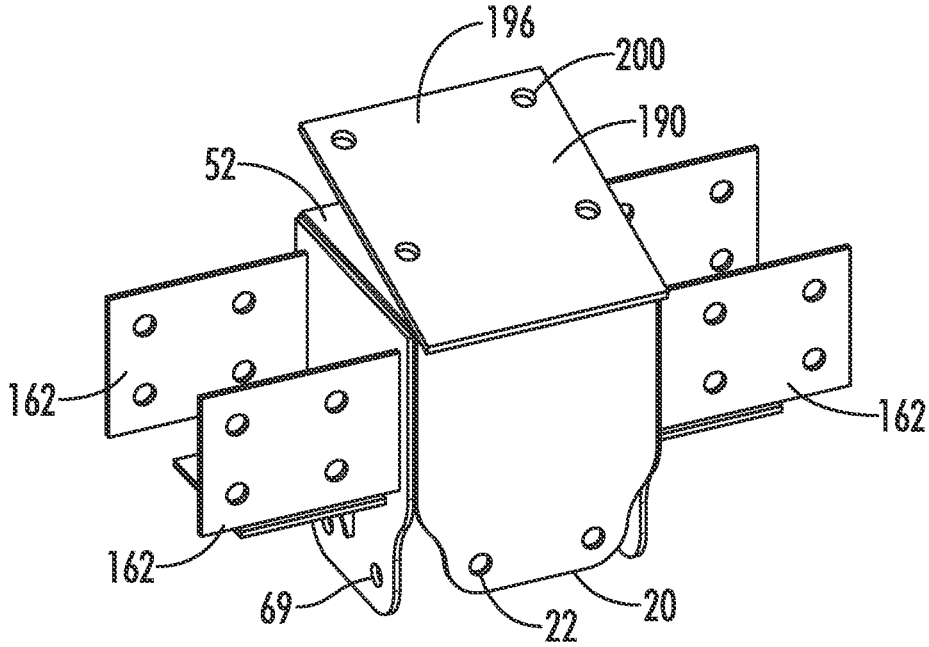
FIG. 36 is a side perspective view of the rafter bracket of FIG. 30.

More particularly, in the embodiments of FIGS. 30-39, the rafter bracket 10, which is particularly suited for steel rafters 16, includes at least one upper brace plate 176 comprising a brace plate top 178, which may be above the first, second, third and fourth lower vertical side plate tops 24, 40, 68, and 80 and above the horizontal plate 52, a brace plate bottom 180 extending from the horizontal plate 52, a brace plate height 182 extending from the brace plate top 178 to the brace plate bottom 180 and substantially parallel to the first and second lower vertical side plate heights 28 and 44, a brace plate first end 184, a brace plate second end 186, and a brace plate length 188 extending from the brace plate first end 184 to the brace plate second end 186 and generally perpendicular to the brace plate height 182. Optionally, the rafter bracket 10 further includes an upper plate 190 resting on the brace plate top 178. The upper plate 190 may be oriented so that it's not parallel to the horizontal plate 52 (e.g., at an angle 192 of between about 5 degrees and about 60 degrees relative to the horizontal plate 52, as depicted in FIG. 33 for example. The angle 192 will depend on the pitch of the roof). The upper plate 190 may include a bottom surface 194 facing the horizontal plate 52, a top surface 196 opposite the bottom surface 194 and a thickness 198 extending from the bottom surface 194 to the top surface 196. Optionally, the at least one upper brace plate 174 tapers in increasing height 182 from the first end 184 to the second end 186, as best seen in FIG. 35. Optionally, the upper plate 190 comprises at least one fastener aperture 200 extending from the upper plate top surface 196 to the upper plate bottom surface 194. Optionally, as with the prior embodiments, in the rafter bracket 10 of FIGS. 30-39, the vertical post 12 of the building 14 is positioned between the first, second, third and fourth lower vertical side plates 20, 36, 66, and 78 in the lower cavity 90 and the rafter 16 of the building 14 is positioned on the upper plate top surface 196, as best seen in FIGS. 30-32. Optionally, at least one upper fastener 202 is positioned through an upper plate fastener aperture 200 and the rafter 16, as best seen in FIG. 32. Optionally, at least one lower fastener 150 is positioned through a fastener aperture 22 of the first lower vertical side plate 20, into and optionally through the vertical post 12 and optionally, then through a fastener aperture 38 of the second lower vertical side plate 36. Optionally, as best seen in FIGS. 32, 35 and 37-39, as with the prior embodiments, the third and fourth lower vertical side plate fastener apertures 69 and 79 may be aligned. The first and second lower vertical side plate fastener apertures 20 (not shown in FIG. 35) and 38 may be vertically aligned with each other and located above or below the third and fourth lower vertical side plate fastener apertures 69 and 79 so that a first lower fastener 150 may be positioned through a fastener aperture 22 of the first lower vertical side plate 20, through the vertical post 12 and then through a fastener aperture 38 of the second lower vertical side plate 36 and another lower fastener 150 may be positioned through a fastener aperture 69 of the third lower vertical side plate 66, through the vertical post 12 and then through a fastener aperture 79 of the fourth lower vertical side plate 78 with interfering with the first lower fastener 150. Optionally, the at least one upper brace plate 176 is substantially triangular/wedge-shaped in shape, as best seen in FIG. 35. Optionally, the rafter bracket 10 comprises two identically shaped and sized upper brace plates 176 that are separated by a space 206 and that are oriented substantially parallel to each other, as best seen in FIG. 33. Optionally, the distance 204 between the upper brace plates 176 is substantially constant along the brace plate length 188. Except as otherwise noted, the rafter bracket 10 of FIGS. 30-39 may be otherwise similar to any of the rafter brackets 10 described above and may include for example the lateral plates 162 and 166, as shown in FIGS. 30-39. Optionally, as with the prior embodiments, the third lower vertical side plate 66 and fourth lower vertical side plate 78 are separated a distance 208 that is substantially constant along the third lower vertical side plate and fourth lower vertical side plate lengths 88 and substantially parallel to the horizontal plate width 58.

Figure 37:
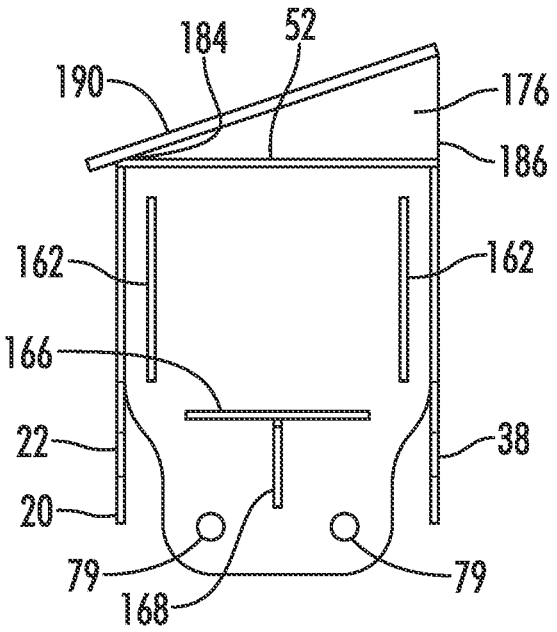
FIG. 37 is a side elevation view of the rafter bracket of FIG. 30.
Figure 38:
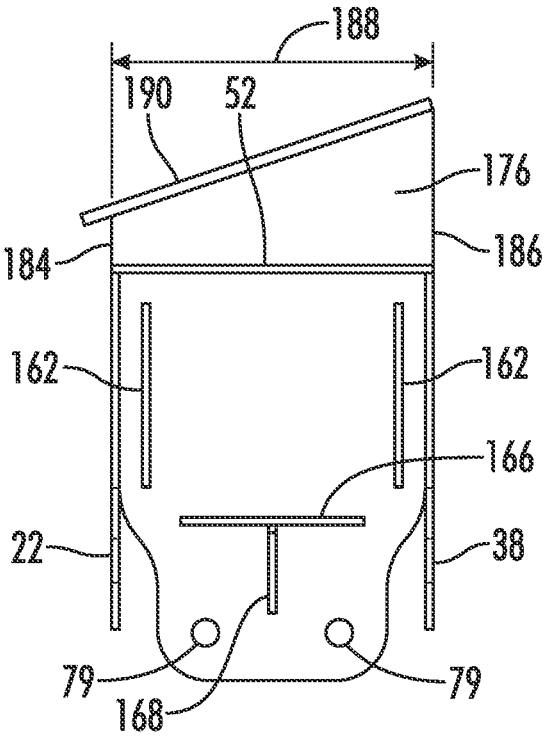
FIG. 38 is a side elevation view of a rafter bracket of another embodiment of the present invention.
Figure 39:
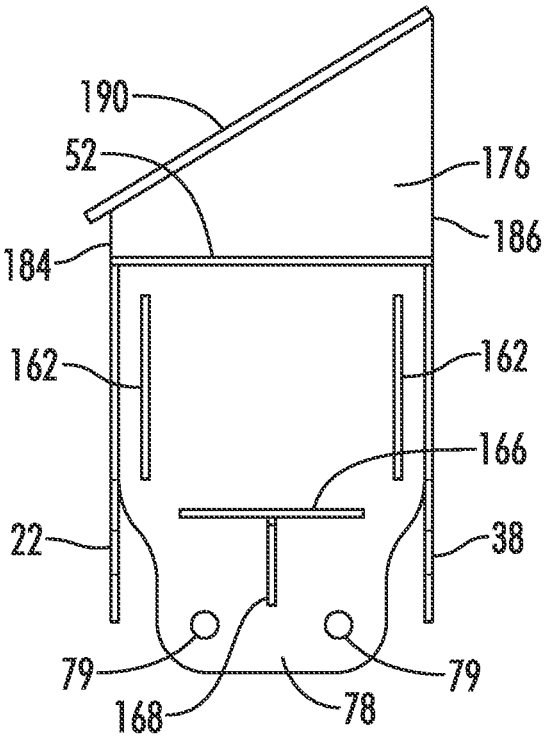
FIG. 39 is a side elevation view of a rafter bracket of another embodiment of the present invention.

As compared to FIGS. 37, in FIGS. 38-39, the upper plate 190 is not also resting on the horizontal plate 52 to provide additional space for fasteners underneath.

| Part List | |
|---|---|
| rafter bracket | 10 |
| purlin | 11 |
| vertical post/stud | 12 |
| building | 14 |
| rafter | 16 |
| roof | 18 |
| first lower vertical side plate | 20 |
| first lower vertical side plate fastener hole | 22 |
| first lower vertical side plate top | 24 |
| first lower vertical side plate bottom | 26 |
| first lower vertical side plate height | 28 |
| first lower vertical side plate first end | 30 |
| first lower vertical side plate second end | 32 |
| first lower vertical side plate width | 34 |
| second lower vertical side plate | 36 |
| second lower vertical side plate fastener hole | 38 |
| second lower vertical side plate top | 40 |
| second lower vertical side plate bottom | 42 |
| second lower vertical side plate height | 44 |
| second lower vertical side plate first end | 46 |
| second lower vertical side plate second end | 48 |
| second lower vertical side plate width | 50 |
| horizontal plate | 52 |
| horizontal plate first end | 54 |
| horizontal plate second end | 56 |
| horizontal plate width | 58 |
| horizontal plate proximal end | 60 |
| horizontal plate distal end | 62 |
| horizontal plate length | 64 |
| third lower vertical side plate | 66 |
| third lower vertical side plate top | 68 |
| third lower vertical side plate fastener hole | 69 |

-continued

| Part List | |
|---|---|
| third lower vertical side plate bottom | 70 |
| third lower vertical side plate height | 71 |
| third lower vertical side plate proximal end | 72 |
| third lower vertical side plate distal end | 74 |
| third lower vertical side plate length | 76 |
| fourth lower vertical side plate | 78 |
| fourth lower vertical side plate fastener hole | 79 |
| fourth lower vertical side plate top | 80 |
| fourth lower vertical side plate bottom | 82 |
| fourth lower vertical side plate height | 83 |
| fourth lower vertical side plate proximal end | 84 |
| fourth lower vertical side plate distal end | 86 |
| fourth lower vertical side plate length | 88 |
| lower cavity | 90 |
| first upper vertical side plate | 92 |
| first upper vertical side plate fastener hole | 94 |
| first upper vertical side plate top | 96 |
| first upper vertical side plate bottom | 98 |
| first upper vertical side plate height | 100 |
| first upper vertical side plate first end | 102 |
| first upper vertical side plate second end | 104 |
| first upper vertical side plate length | 106 |
| second upper vertical side plate | 108 |
| second upper vertical side plate fastener hole | 110 |
| second upper vertical side plate top | 112 |
| second upper vertical side plate bottom | 114 |
| second upper vertical side plate height | 116 |
| second upper vertical side plate first end | 118 |
| second upper vertical side plate second end | 120 |
| second upper vertical side plate length | 122 |
| third upper vertical side plate | 124 |
| third upper vertical side plate top | 126 |
| third upper vertical side plate bottom | 128 |
| third upper vertical side plate first end | 130 |
| third upper vertical side plate second end | 132 |
| third upper vertical side plate length | 134 |
| third upper vertical side plate height | 135 |
| upper cavity | 136 |
| first distance | 138 |
| second distance | 140 |
| angle | 142 |
| rafter first end | 144 |
| rafter second end | 146 |
| rafter length | 148 |
| fasteners | 150 |
| vertical post height | 152 |
| vertical post top end | 154 |
| vertical post bottom end | 158 |
| beam | 160 |
| side lateral plate | 162 |
| lateral cavity | 164 |
| bottom lateral plate | 166 |
| brace | 168 |
| side lateral plate fastener apertures | 170 |
| beam | 172 |
| bottom lateral plate fastener aperture | 174 |
| upper brace plate | 176 |
| Brace plate top | 178 |
| Brace plate bottom | 180 |
| Brace plate height | 182 |
| Brace plate first end | 184 |
| Brace plate second end | 186 |
| Brace plate length | 188 |
| Upper plate | 190 |
| Angle | 192 |
| Upper plate bottom surface | 194 |
| Upper plate top surface | 196 |
| Upper plate thickness | 198 |
| Upper plate fastener aperture | 200 |
| Upper plate fastener | 202 |
| Distance between upper brace plates | 204 |
| Space | 206 |
| Distance between third and fourth lower vertical plates | 208 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of using a rafter bracket to connect a vertical post of a building to a rafter and beam of the building, the method comprising:

a) providing the rafter bracket comprising:

a first lower vertical side plate comprising at least one first lower vertical side plate fastener aperture, a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and substantially perpendicular to the first lower vertical side plate height;

a second lower vertical side plate opposite the first lower vertical side plate and extending substantially parallel to the first lower vertical side plate, the second lower vertical side plate comprising at least one second lower vertical side plate fastener aperture, a second lower vertical side plate top, a second lower vertical side plate bottom, a second lower vertical side plate height extending from the second lower vertical side plate top to the second lower vertical side plate bottom and substantially parallel to the first lower vertical side plate height, a second lower vertical side plate first end, a second lower vertical side plate second end opposite the first end, and a second lower vertical side plate width extending from the second lower vertical side plate first end to the second lower vertical side plate second end and substantially perpendicular to the second lower vertical side plate height;

a horizontal plate connected to at least one of the first and second lower vertical side plates, the horizontal plate located above the first and second lower vertical side plate bottoms, the horizontal plate extending substantially perpendicular to the first and second lower vertical side plate heights, the horizontal plate comprising a horizontal plate first end, a horizontal plate second end, a horizontal plate width extending from the horizontal plate first end to the horizontal plate second end and substantially parallel to the first lower vertical side plate width and second lower vertical side plate width, a horizontal plate proximal end, a horizontal plate distal end, and a horizontal plate length extending from the horizontal plate proximal end to the horizontal plate distal end and substantially perpendicular to the horizontal plate width;

a lower cavity defined by the first and second lower vertical side plates;

at least one upper brace plate resting on the horizontal plate and comprising a brace plate top above the first and second lower vertical side plate tops and above the horizontal plate, a brace plate bottom extending from the horizontal plate, a brace plate height extending from the brace plate top to the brace plate bottom and substantially parallel to the first and second lower vertical side plate heights, a brace plate first end, a brace plate second end, and a brace plate length extending from the brace plate first end to the brace plate second end and substantially perpendicular to the brace plate height;

an upper plate connected to the horizontal plate, the upper plate oriented at an angle greater than one degree and less than ninety degrees relative to the horizontal plate, the upper plate comprising a bottom surface facing the horizontal plate and a top surface opposite the bottom surface, wherein the upper plate rests on the brace plate top;

wherein the upper plate comprises at least one fastener aperture extending from the upper plate top surface to the upper plate bottom surface, wherein the first lower vertical side plate and second lower vertical side plate are separated a first distance, the first distance substantially constant along the first lower vertical side plate and second lower vertical side plate widths and substantially parallel to the horizontal plate length, and wherein at least a respective one of the first and second lower vertical side plates comprise a plurality of lateral plates extending laterally away from the respective lower vertical side plate and lower cavity and defining a lateral cavity;

b) positioning the rafter of the building on the upper plate top surface so that the rafter extends upwardly at an acute angle relative to the horizontal plate from the horizontal plate distal end to the horizontal plate proximal end;

c) positioning the beam of the building in the lateral cavity; and d) positioning the vertical post of the building between the first and second lower vertical side plates in the lower cavity.

2. The method of claim 1 further comprising positioning at least one upper fastener through a respective upper plate fastener aperture and into the rafter, and further wherein at least one lower fastener is positioned through a respective fastener aperture of the first and second lower vertical side plates and into the vertical post.

3. The method of claim 1 wherein the lateral cavity has an open top.

* * * * *